US006995737B2

(12) United States Patent
LeChevalier

(10) Patent No.: US 6,995,737 B2
(45) Date of Patent: Feb. 7, 2006

(54) METHOD AND SYSTEM FOR ADJUSTING PRECHARGE FOR CONSISTENT EXPOSURE VOLTAGE

(75) Inventor: Robert LeChevalier, Golden, CO (US)

(73) Assignee: Clare Micronix Integrated Systems, Inc., Alisa Viejo, CA (US)

( * ) Notice: Subject to any disclaimer, the term of this patent is extended or adjusted under 35 U.S.C. 154(b) by 379 days.

(21) Appl. No.: 10/274,511

(22) Filed: Oct. 17, 2002

(65) Prior Publication Data

US 2004/0004590 A1 Jan. 8, 2004

Related U.S. Application Data

(60) Provisional application No. 60/342,637, filed on Oct. 19, 2001, provisional application No. 60/343,856, filed on Oct. 19, 2001, provisional application No. 60/343,638, filed on Oct. 19, 2001, provisional application No. 60/342,582, filed on Oct. 19, 2001, provisional application No. 60/346,102, filed on Oct. 19, 2001, provisional application No. 60/353,753, filed on Oct. 19, 2001, provisional application No. 60/342,793, filed on Oct. 19, 2001, provisional application No. 60/342,791, filed on Oct. 19, 2001, provisional application No. 60/343,370, filed on Oct. 19, 2001, provisional application No. 60/342,783, filed on Oct. 19, 2001, provisional application No. 60/342,794, filed on Oct. 19, 2001.

(51) Int. Cl.
*G09G 3/32* (2006.01)

(52) U.S. Cl. ..... 345/82; 345/204; 313/463; 315/169.1; 315/169.3

(58) Field of Classification Search ..... 345/76, 345/82, 84, 204, 42, 52, 60, 74.1, 78, 87, 345/690, 211; 315/169.1, 169.2, 169.3; 313/463
See application file for complete search history.

(56) References Cited

U.S. PATENT DOCUMENTS 4,236,199 A 11/1980 Stewart (Continued)

FOREIGN PATENT DOCUMENTS

EP 0 678 849 A1 10/1995

(Continued)

OTHER PUBLICATIONS

International Search Report for International Application No. PCT/US02/33574, filed Oct. 17, 2002, dated Jun. 23, 2003.

(Continued)

*Primary Examiner*—Henry N. Tran
(74) *Attorney, Agent, or Firm*—Knobbe, Martens, Olson & Bear, LLP

(57) ABSTRACT

A method and system for controlling a voltage used for precharging current-driven elements in a matrix, and a method of manufacturing a device to perform this function. Elements are driven during successive scan cycles, each having a precharge period and an exposure period. The elements conduct current during conduction periods, which typically have variable length within exposure periods. Conduction voltages are sensed at earlier times (e.g., near the beginning) and later times (e.g., near the end) within conduction periods. A precharge voltage is adapted based on a comparison of the earlier and later sensed conduction voltages, typically so as to reduce any average difference and thereby cause the voltage during exposure to be consistent.

66 Claims, 9 Drawing Sheets

U.S. PATENT DOCUMENTS

| | | | | |
|---|---|---|---|---|
| 4,366,504 | A * | 12/1982 | Kanatani | 348/800 |
| 4,603,269 | A | 7/1986 | Hochstein | |
| RE32,526 | E | 10/1987 | Hochstein | |
| 4,823,121 | A | 4/1989 | Sakamoto et al. | |
| 5,117,426 | A | 5/1992 | McAdams | |
| 5,162,688 | A | 11/1992 | Bouton | |
| 5,514,995 | A | 5/1996 | Hennig | |
| 5,519,712 | A | 5/1996 | Shu et al. | |
| 5,594,463 | A * | 1/1997 | Sakamoto | 345/76 |
| 5,606,527 | A | 2/1997 | Kwack et al. | |
| 5,672,992 | A | 9/1997 | Nadd | |
| 5,686,936 | A * | 11/1997 | Maekawa et al. | 345/100 |
| 5,689,208 | A | 11/1997 | Nadd | |
| 5,708,454 | A | 1/1998 | Katoh et al. | |
| 5,764,207 | A | 6/1998 | Maekawa et al. | |
| 5,818,268 | A | 10/1998 | Kim et al. | |
| 5,844,368 | A | 12/1998 | Okuda et al. | |
| 5,949,194 | A | 9/1999 | Kawakami et al. | |
| 5,952,789 | A | 9/1999 | Stewart et al. | |
| 6,067,061 | A | 5/2000 | Friedman | |
| 6,075,739 | A | 6/2000 | Ihara | |
| 6,181,314 | B1 | 1/2001 | Nakajima et al. | |
| 6,191,534 | B1 | 2/2001 | Schuler et al. | |
| 6,201,717 | B1 | 3/2001 | Grant | |
| 6,229,508 | B1 * | 5/2001 | Kane | 345/82 |
| 6,313,819 | B1 | 11/2001 | Maekawa et al. | |
| 6,366,116 | B1 | 4/2002 | Juang | |
| 6,433,488 | B1 | 8/2002 | Bu | |
| 6,448,948 | B1 | 9/2002 | Friedman | |
| 6,473,064 | B1 | 10/2002 | Tsuchida et al. | |
| 6,489,631 | B2 | 12/2002 | Young et al. | |
| 6,583,775 | B1 | 6/2003 | Sekiya et al. | |
| 6,594,606 | B2 | 7/2003 | Everitt | |
| 6,633,135 | B2 | 10/2003 | Nara et al. | |
| 6,650,308 | B2 | 11/2003 | Kawashima | |
| 6,661,401 | B1 | 12/2003 | Sekine | |
| 6,714,177 | B1 | 3/2004 | Ishizuka | |
| 6,859,193 | B1 | 2/2005 | Yumoto | |

FOREIGN PATENT DOCUMENTS

| | | |
|---|---|---|
| EP | 1 071 070 A2 | 1/2001 |
| EP | 1 081 836 A2 | 3/2001 |
| EP | 1 071 070 A3 | 1/2002 |
| GB | 2 337 354 A | 12/1995 |
| GB | 2 339 638 A | 2/2000 |
| JP | 07-199861 | 6/1984 |
| JP | 59-97223 | 6/1984 |
| JP | 4-172963 | 6/1992 |
| JP | 7-322605 | 12/1995 |
| JP | 11-330376 | 11/1999 |
| WO | WO 01/27910 A1 | 4/2001 |

OTHER PUBLICATIONS

International Search Report dated Jun. 26, 2003 for International Application No. PCT/US02/33364, filed Oct. 17, 2002.

International Search Report dated Jun. 26, 2003 for International Application No. PCT/US02/33428, filed Oct. 17, 2002.

International Search Report dated Jun. 26, 2003 for International Application No. PCT/US02/33519, filed Oct. 17, 2002.

International Search Report dated Nov. 27, 2003 for International Application No. PCT/US02/14699, filed May 7, 2002.

International Search Report dated Nov. 28, 2003 for International Application No. PCT/US02/14686, filed May 7, 2002.

International Search Report for International Application No. PCT/US02/33375, filed Oct. 17, 2002, dated Jun. 23, 2003.

International Search Report for International Application No. PCT/US02/33426, filed Oct. 17, 2002, dated Jun. 23, 2003.

International Search Report dated Apr. 8, 2004 for International Application No. PCT/US02/33373.

* cited by examiner

METHOD AND SYSTEM FOR ADJUSTING PRECHARGE FOR CONSISTENT EXPOSURE VOLTAGE

RELATED APPLICATIONS

This application claims priority to, and hereby incorporates by reference, the following patent applications:

U.S. Provisional Patent Application No. 60/342,637, filed on Oct. 19, 2001, entitled PROPORTIONAL PLUS INTEGRAL LOOP COMPENSATION USING A HYBRID OF SWITCHED CAPACITOR AND LINEAR AMPLIFIERS;

U.S. Provisional Patent Application No. 60/343,856, filed on Oct. 19, 2001, entitled CHARGE PUMP ACTIVE GATE DRIVE;

U.S. Provisional Patent Application No. 60/343,638, filed on Oct. 19, 2001, entitled CLAMPING METHOD AND APPARATUS FOR SECURING A MINIMUM REFERENCE VOLTAGE IN A VIDEO DISPLAY BOOST REGULATOR;

U.S. Provisional Patent Application No. 60/342,582, filed on Oct. 19, 2001, entitled PRECHARGE VOLTAGE ADJUSTING METHOD AND APPARATUS;

U.S. Provisional Patent Application No. 60/346,102, filed on Oct. 19, 2001, entitled EXPOSURE TIMING COMPENSATION FOR ROW RESISTANCE;

U.S. Provisional Patent Application No. 60/353,753, filed on Oct. 19, 2001, entitled METHOD AND SYSTEM FOR PRECHARGING OLED/PLED DISPLAYS WITH A PRECHARGE SWITCH LATENCY;

U.S. Provisional Patent Application No. 60/342,793, filed on Oct. 19, 2001, entitled ADAPTIVE CONTROL BOOST CURRENT METHOD AND APPARATUS, filed on Oct. 19, 2001;

U.S. Provisional Patent Application No. 60/342,791, filed on Oct. 19, 2001, entitled PREDICTIVE CONTROL BOOST CURRENT METHOD AND APPARATUS;

U.S. Provisional Patent Application No. 60/343,370, filed on Oct. 19, 2001, entitled RAMP CONTROL BOOST CURRENT METHOD AND APPARATUS;

U.S. Provisional Patent Application No. 60/342,783, filed on Oct. 19, 2001, entitled ADJUSTING PRECHARGE FOR CONSISTENT EXPOSURE VOLTAGE; and U.S. Provisional Patent Application No. 60/342,794, filed on Oct. 19, 2001, entitled PRECHARGE VOLTAGE CONTROL VIA EXPOSURE VOLTAGE RAMP;

This application is related to, and hereby incorporates by reference, the following patent applications:

U.S. Provisional Application No. 60/290,100, filed May 9, 2001, entitled "METHOD AND SYSTEM FOR CURRENT BALANCING IN VISUAL DISPLAY DEVICES";

U.S. patent application entitled "CURRENT BALANCING CIRCUIT", filed May 7, 2002 Ser. No. 10/141,650;

U.S. patent application entitled "CURRENT BALANCING CIRCUIT", filed May 7, 2002 Ser. No. 10/141,325;

U.S. patent application Ser. No. 09/904,960, filed Jul. 13, 2001, entitled "BRIGHTNESS CONTROL OF DISPLAYS USING EXPONENTIAL CURRENT SOURCE";

U.S. patent application Ser. No. 10/141,659, filed on May 7, 2002, entitled "MATCHING SCHEME FOR CURRENT CONTROL IN SEPARATE I.C.S.";

U.S. patent application Ser. No. 10/141,326, filed May 7, 2002, entitled "MATCHING SCHEME FOR CURRENT CONTROL IN SEPARATE I.C.S.";

U.S. patent application Ser. No. 09/852,060, filed May 9, 2001, entitled "MATRIX ELEMENT VOLTAGE SENSING FOR PRECHARGE";

U.S. patent application entitled "METHOD AND SYSTEM FOR PROPORTIONAL AND INTEGRAL LOOP COMPENSATION USING A HYBRID OF SWITCHED CAPACITOR AND LINEAR AMPLIFIERS", filed on even date herewith Ser. No. 10/274,429;

U.S. patent application entitled "METHOD AND SYSTEM FOR CHARGE PUMP ACTIVE GATE DRIVE", filed on even date herewith Ser. No. 10/274,488;

U.S. patent application entitled "METHOD AND CLAMPING APPARATUS FOR SECURING A MINIMUM REFERENCE VOLTAGE IN A VIDEO DISPLAY BOOST REGULATOR", filed on even date herewith Ser. No. 10/274,428;

U.S. patent application Ser. No. 10/141,648, filed May 7, 2002, entitled "APPARATUS FOR PERIODIC ELEMENT VOLTAGE SENSING TO CONTROL PRECHARGE" Ser. No. 10/274,489;

U.S. patent application Ser. No. 10/141,318, filed May 7, 2002, entitled "METHOD FOR PERIODIC ELEMENT VOLTAGE SENSING TO CONTROL PRECHARGE,";

U.S. patent application entitled "MATRIX ELEMENT PRECHARGE VOLTAGE ADJUSTING APPARATUS AND METHOD", filed on even date herewith;

U.S. patent application entitled "SYSTEM AND METHOD FOR EXPOSURE TIMING COMPENSATION FOR ROW RESISTANCE", filed on even date herewith Ser. No. 10/274,491;

U.S. patent application entitled "METHOD AND SYSTEM FOR PRECHARGING OLED/PLED DISPLAYS WITH A PRECHARGE LATENCY", filed on even date herewith Ser. No. 10/274,421;

U.S. Provisional Application No. 60/348,168 filed Oct. 19, 2001, entitled "PULSE AMPLITUDE MODULATION SCHEME FOR OLED DISPLAY DRIVER", filed on even date herewith;

U.S. patent application Ser. No. 10/029,563, filed Dec. 20, 2001, entitled "METHOD OF PROVIDING PULSE AMPLITUDE MODULATION FOR OLED DISPLAY DRIVERS";

U.S. patent application Ser. No. 10/029,605, filed Dec. 20, 2001, entitled "SYSTEM FOR PROVIDING PULSE AMPLITUDE MODULATION FOR OLED DISPLAY DRIVERS";

U.S. patent application entitled "ADAPTIVE CONTROL BOOST CURRENT METHOD AND APPARATUS", filed on even date herewith Ser. No. 10/274,513;

U.S. patent application entitled "PREDICTIVE CONTROL BOOST CURRENT METHOD AND APPARATUS", filed on even date herewith Ser. No. 10/274,490;

U.S. patent application entitled "RAMP CONTROL BOOST CURRENT METHOD", filed on even date herewith Ser. No. 10/274,500; and U.S. patent application entitled "METHOD AND SYSTEM FOR RAMP CONTROL OF PRECHARGE VOLTAGE", filed on even date herewith Ser. No. 10/274,502.

FIELD OF THE INVENTION

This invention generally relates to electrical drivers for a matrix of current driven devices, and more particularly to methods and apparatus for determining and providing a precharge for such devices.

DESCRIPTION OF THE RELATED ART

There is a great deal of interest in "flat panel" displays, particularly for small to midsized displays, such as may be used in laptop computers, cell phones, and personal digital assistants. Liquid crystal displays (LCDs) are a well-known example of such flat panel video displays, and employ a matrix of "pixels" which selectably block or transmit light. LCDs do not provide their own light; rather, the light is provided from an independent source. Moreover, LCDs are operated by an applied voltage, rather than by current. Luminescent displays are an alternative to LCD displays. Luminescent displays produce their own light, and hence do not require an independent light source. They typically include a matrix of elements that luminesce when excited by current flow. A common luminescent device for such displays is a light emitting diode (LED).

LED arrays produce their own light in response to current flowing through the individual elements of the array. The current flow may be induced by either a voltage source or a current source. A variety of different LED-like luminescent sources have been used for such displays. The embodiments described herein utilize organic electroluminescent materials in OLEDs (organic light emitting diodes), which include polymer OLEDs (PLEDs) and small-molecule OLEDs, each of which is distinguished by the molecular structure of their color and light producing material as well as by their manufacturing processes. Electrically, these devices look like diodes with forward "on" voltage drops ranging from 2 volts (V) to 20 V depending on the type of OLED material used, the OLED aging, the magnitude of current flowing through the device, temperature, and other parameters. Unlike LCDs, OLEDs are current driven devices; however, they may be similarly arranged in a 2 dimensional array (matrix) of elements to form a display.

OLED displays can be either passive-matrix or active-matrix. Active-matrix OLED displays use current control circuits integrated with the display itself, with one control circuit corresponding to each individual element on the substrate, to create high-resolution color graphics with a high refresh rate. Passive-matrix OLED displays are easier to build than active-matrix displays, because their current control circuitry is implemented external to the display. This allows the display manufacturing process to be significantly simplified.

FIG. 1A is an exploded view of a typical physical structure of such a passive-matrix display 100 of OLEDs. A layer 110 having a representative series of rows, such as parallel conductors 111–118, is disposed on one side of a sheet of light emitting polymer, or other emissive material, 120. A representative series of columns are shown as parallel transparent conductors 131–138, which are disposed on the other side of sheet 120, adjacent to a glass plate 140. FIG. 1B is a cross-section of the display 100, and shows a drive voltage V applied between a row 111 and a column 134. A portion of the sheet 120 disposed between the row 111 and the column 134 forms an element 150, which behaves like an LED. The potential developed across this LED causes current flow, so the LED emits light 170. Since the emitted light 170 must pass through the column conductor 134, such column conductors are transparent. Most such transparent conductors have relatively high resistance compared with the row conductors 111–118, which may be formed from opaque materials, such as copper, having a low resistivity.

This structure results in a matrix of devices, one device formed at each point where a row overlies a column. There will generally be M×N devices in a matrix having M rows and N columns. Typical devices function like light emitting diodes (LEDs), which conduct current and luminesce when voltage of one polarity is imposed across them, and block current when voltage of the opposite polarity is applied. Exactly one device is common to both a particular row and a particular column, so to control these individual LED devices located at the matrix junctions it is useful to have two distinct drive circuits, one to drive the column and one to drive the row. It is conventional to sequentially scan the rows (conventionally connected to device cathodes) with a driver switch to a known voltage such as ground, and to provide another driver, which may be a current source, to drive the columns (which are conventionally connected to device anodes).

Portions of FIG. 2 represent such a conventional arrangement for driving a display having M rows and N columns. A column driver device 260 includes one column drive circuit (e.g. 262, 264, 266) for each column. The column drive circuit 264 shows some of the details that are typically provided in each column drive circuit, including a current source 270 and a switch 272, which enables a column connection 274 to be connected to either the current source 270 to illuminate the selected diode, or to ground to turn off the selected diode. A scan circuit or row driver device 250 includes representations of row drive switches (208, 218, 228, 238 and 248). A luminescent display 280 represents a display having M rows and N columns, though only five representative rows and three representative columns are drawn.

The rows of FIG. 2 are typically a series of parallel connection lines traversing the back of a polymer, organic or other luminescent sheet, and the columns are a second series of connection lines perpendicular to the rows and traversing the front of such sheet, as shown in FIG. 1A. Luminescent elements are established at each region where a row and a column overlie each other so as to form connections on either side of the element. FIG. 2 represents each element as including both an LED aspect (indicated by a diode schematic symbol) and a parasitic capacitor aspect (indicated by a capacitor symbol labeled "C").

In operation, information is transferred to the matrix display by scanning each row in sequence. During each row scan period, each column connected to an element intended to emit light is also driven. For example, in FIG. 2 a row switch 228 grounds the row to which the cathodes of elements 222, 224 and 226 are connected during a scan of Row K. The column drive switch 272 connects the column connection 274 to the current source 270, such that the element 224 is provided with current. Each of the other columns 1 to N may also be providing current to the respective elements connected to Row K at this time, such as the elements 222 or 226. All current sources are typically at the same amplitude. Controlling the amount of time the current source for the particular column is on controls OLED element light output. When an OLED element has completed outputting light, its anode is pulled to ground to turn off the element. At the end of the scan period for Row K, the row switch 228 will typically disconnect Row K from ground and apply Vdd instead. Then, the scan of the next row will begin, with row switch 238 connecting the row to ground, and the appropriate column drive circuits supplying current to the desired elements, e.g. 232, 234 and/or 236.

Only one element (e.g. element 224) of a particular column (e.g. column J) is connected to each row (e.g. Row K), and hence only that element of the column is connected to both the particular column drive (264) and row drive (228) so as to conduct current and luminesce (or be "exposed") during the scan of that row. However, each of the other devices on that particular column (e.g. elements 204, 214, 234 and 244 as shown, but typically including many other devices) is connected by the driver for their respective row (208, 218, 238 and 248 respectively) to a voltage source, Vdd. Therefore, the parasitic capacitance of each of the devices of the column is effectively in parallel with, or added to, the capacitance of the element being driven. The combined parasitic capacitance of the column limits the slew rate of a current drive such as drive 270 of column J. Nonetheless, rapid driving of the elements is necessary. All rows must be scanned many times per second to obtain a reasonable visual appearance, which permits very little time for conduction for each row. Low slew rates may cause large exposure errors for short exposure periods. Thus, for practical implementations of display drivers using the prior art scheme, the parasitic capacitance of the columns may be a severe limitation on drive accuracy.

A luminescent device matrix and drive system as shown in FIG. 2 is described, for example, in U.S. Pat. No. 5,844,368 (Okuda et al.). To mitigate the effects of parasitic capacitances, Okuda suggests, for example, resetting each element between scans by applying either ground or Vcc (10V) to both sides of each element at the end of each exposure period. To initiate scanning a row, Okuda suggests conventionally connecting all unscanned rows to Vcc, and grounding the scanned row. An element being driven by a selected column line is therefore provided current from the parasitic capacitance of each element of the column line that is attached to an unscanned row. The Okuda patent does not reveal any means to establish the correct voltage for a selected element at the moment of turn-on. In many applications the voltage required for display elements at a given current will vary as a function of display manufacturing variations, display aging and ambient temperature, and Okuda also fails to provide any means to compensate for such variation.

In view of the above, it may be appreciated that there is a need for a precharge process to reduce the substantial errors in OLED current that may result from employing a current drive for rapid scanning of OLED devices in a matrix having a large parasitic capacitance. Moreover, since the voltage for an OLED varies substantially with temperature, process, and display aging, a need may also be appreciated to monitor the "on" voltage of the OLEDs and change the precharge process accordingly. Thus, what is needed in this industry is a means to determine and apply correct voltages at the beginning of scans of current-driven devices in an array.

SUMMARY OF THE INVENTION

In response to the needs discussed above, a method is presented for monitoring display conduction voltages at different times relative to exposure conduction periods, comparing "early" voltages from relatively earlier within corresponding conduction periods to "late" voltages from relatively later in their respective conduction period(s), and driving the precharge voltage until the difference is as desired. The invention may be embodied a number of ways, as described in the detailed description. A method of making a device to do this is also presented.

A first embodiment, which may be used to adaptively control a precharge voltage for provision to a matrix display connection, includes driving a first conduction current during a first conduction period through a first matrix connection to a first matrix element connected thereto, and also determining an early conduction voltage of a path of the first conduction current at an early time which is nearer to a beginning than to an end of the first conduction period. The embodiment further includes driving a second conduction current during a second conduction period through a second matrix element connected to a second matrix connection, and determining a late conduction voltage of a path of the second conduction current at a late time which is longer after a beginning of the second conduction period than the time period between the beginning of the first conduction current and the early time. Moreover, the embodiment includes adjusting a precharge voltage in response to a difference between a combination of one or more early conduction voltages and a combination of one or more late conduction voltages.

Another embodiment is a method of manufacturing an apparatus which may be used for adaptively controlling a level of precharge voltage applied to matrix connections. This embodiment includes controllably connecting a first current source and a first matrix connection as a first current drive circuit, and configuring the first current drive circuit to controllably couple current from the first current source to the first matrix connection during a first conduction period. The embodiment also includes coupling an early voltage sampling circuit to the first matrix connection, and configuring the early voltage sampling circuit to sample an early voltage related to a voltage of the first matrix connection during an early portion of the first conduction period. The embodiment further includes controllably connecting a second current source and a second matrix connection as a second current drive circuit, configuring the second current drive circuit to controllably couple current from the second current source to the second matrix connection during a second conduction period, coupling a late voltage sampling circuit to the second matrix connection, and configuring the late voltage sampling circuit to sample a late voltage related to a voltage of the second matrix connection during a late portion of the second conduction period. This embodiment finally includes controllably coupling a precharge voltage output circuit to a third matrix connection, coupling the early and late voltage sampling circuits to comparison facilities configurable to provide control information based on comparison of the early and late voltages, and configuring the precharge voltage output circuit to output a precharge voltage which reflects the control information from the comparison facilities.

A further embodiment is a method of adaptively controlling a precharge voltage which may be provided to a matrix display connection. This embodiment includes applying a first conduction current to a first matrix connection during a first conduction period, and obtaining early conduction voltages of a path of the first conduction current, as well as applying a second conduction current to a second matrix connection during a second conduction period, and obtaining late conduction voltages of a path of the second conduction current. This embodiment further includes providing a precharge voltage based at least in part on comparison of the early conduction voltages and the late conduction voltages.

One aspect of the invention relates to an apparatus for controlling a precharge voltage provided to at least one display element during a first precharge period. The apparatus comprises means for providing a first current to a first display element during a first conduction period. The apparatus may also comprise means for obtaining an early voltage derived from the first display element at an early time of the first conduction period. The apparatus may further comprise means for providing a second current to a second display element during a second conduction period. The apparatus may also include means for obtaining a late voltage derived from the second display element at a late time of the second conduction period. The apparatus may further comprise means for adjusting a precharge voltage in response to a difference between one or more early voltages and one or more late voltages.

Another feature of the invention is directed to an apparatus for driving at least one to matrix element to a precharge voltage level. The apparatus comprises a first current source coupled to a first conduction line of a first matrix element during a first conduction period. The apparatus further comprises an early voltage sampling circuit configured to sample a voltage relating to the first conduction line during an early portion of the first conduction period as an early voltage sample. The apparatus also includes a second current source coupled to a second conduction line of a second matrix element during a second conduction period. The apparatus further comprises a late voltage sampling circuit configured to sample a voltage relating to the second conduction line during a late portion of the second conduction period as a late voltage sample. The apparatus further includes a comparison circuit configured to compare at least one early voltage sample with at least one late voltage sample. The apparatus also comprises a precharge source configured to adjust a precharge voltage output based at least in part on outcome of the comparison of the early and late voltage samples.

Yet another aspect of the invention relates to an apparatus for displaying information. The apparatus may comprise a matrix of luminescent elements each coupled to a column and a row. The apparatus may also include a row driver circuit configured to enable current flow through elements connected to a selected row during a row scan cycle. The apparatus may further comprise a column driver circuit configured to provide current to column connections of elements during corresponding conduction periods, sample an early voltage from a first column connection voltage, and sample a late voltage from a second column connection voltage. The column driver circuit may also generate a precharge voltage based upon a difference between one or more early voltage values and one or more late voltage values.

BRIEF DESCRIPTION OF THE DRAWINGS

The foregoing and other features and objects of the invention will become more fully apparent from the following description and appended claims taken in conjunction with the following drawings, in which like reference numbers indicate identical or functionally similar elements.

DETAILED DESCRIPTION

The embodiments described below overcome obstacles to the accurate delivery of desired conduction currents to elements of an LED display, particularly in view of impediments which are rather pronounced in OLEDs, such as relatively high parasitic capacitances, and forward voltages which vary with time and temperature. However, the invention is more general than the embodiments that are explicitly described, and is not to be limited by the specific embodiments but rather is defined by the appended claims. In particular, the invention may be applied to enhance the accuracy of current delivered to any matrix of current-driven devices.

Normal Display Drive

Figure 1B:
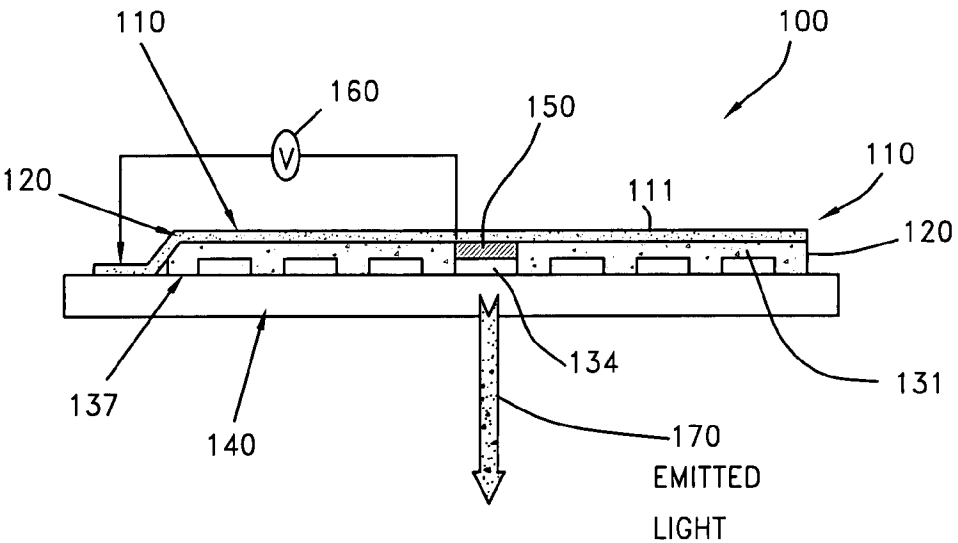
PRIOR ART FIG. 1B
FIG. 1B is a cross-sectional view of the OLED display of FIG. 1A.
Figure 1A:
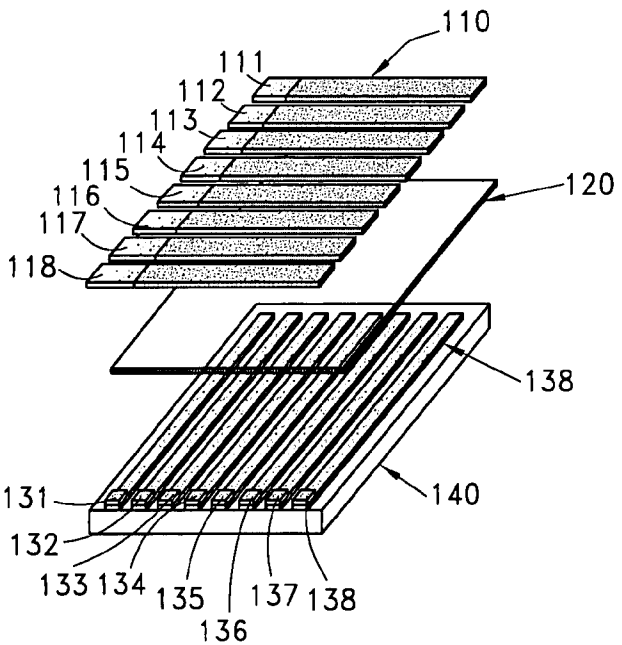
PRIOR ART FIG. 1A
FIG. 1A is a simplified exploded view of an OLED display.
Figure 2:
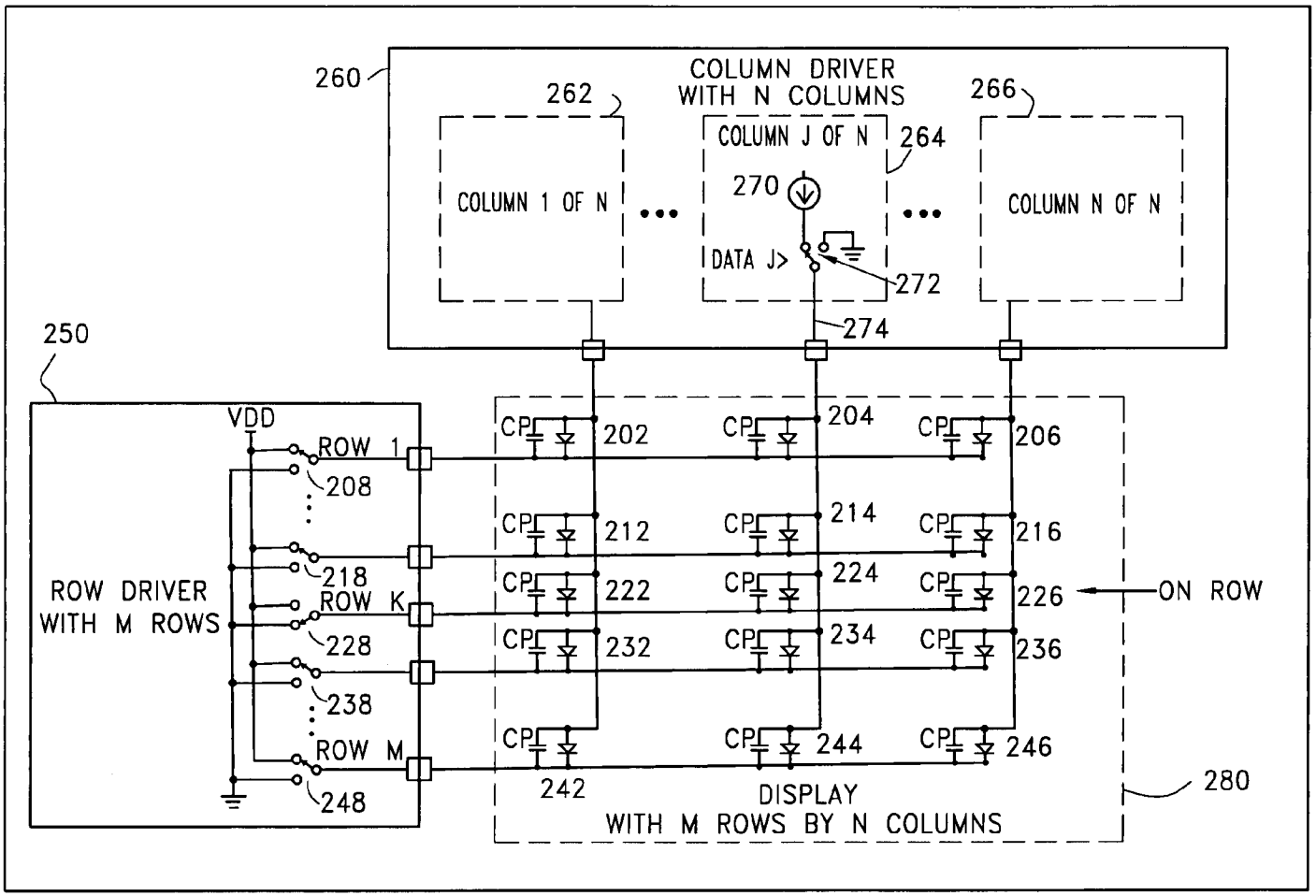
FIG. 2 is a schematic diagram of an OLED display with column and row drivers.

Referring again to FIG. 2, further details are shown of a passive current-device matrix and drive system as used with embodiments described herein. Current sources such as the current source 270 are typically used to drive a predetermined current through a selected pixel element such as the element 224. However, applied current will not flow through any OLED element until the column's parasitic capacitance is first charged to a voltage at which the OLED element can conduct. When the row switch 228 is connected to ground to scan Row K, for all practical purposes the entire column connection 274 must reach a requisite voltage in order to drive the desired current in element 224. The requisite voltage may be about 6V. The voltage is a characteristic of the pixel element, and generally varies as a function of current, temperature, and element age.

Describing an exemplary column, the voltage on the column connection 274 will move from a starting value toward a steady-state value, but not faster than the current source 270 can charge the combined capacitance of all of the parasitic capacitances of the elements connected to the column connection 274. In one display, for example, there may be 96 rows, and thus (typically) 96 devices connected to each column such as the column 274. Each device may have a typical parasitic capacitance value of about 25 pF, for a total column parasitic capacitance of 2400 pF (96×25 pF). A typical value of current from current source 270 is 100 $\mu$A. Under these circumstances, the voltage will not rise faster than about 100 $\mu$A/(96×25 pF), or 1/24 V/$\mu$S, and will change even more slowly as the LED begins to conduct significantly. The result is that the current through the LED (as opposed to the current through the parasitic capacitance) will rise very slowly, and may not achieve the target current by the end of the scan period if the column voltage starts at a low value. For example, if an exemplary display having 96 rows operates at 150 frames per second, then each scan has a duration of not more than 1/150/96 seconds, or less than about 70 $\mu$S. At a typical 100 $\mu$A drive current the voltage can charge at only about 1/24 V/$\mu$S, or 42 mV per $\mu$S (when current begins to flow in the OLED, this charging rate will fall off). At 1/24 V/ES, the voltage would rise by no more than about 2.9 V during the scan period, which would not even bring a column voltage (Vcol) from 0 to a nominal conduction voltage of 6V.

Since the current source 270, alone, will be unable to bring an OLED from zero volts to operating voltage during the entire scan period in the circumstance described above, a distinct "precharge" period may be set aside during which the voltage on each device is driven to a precharge voltage value Vpr. Vpr is ideally the voltage that causes the OLED to achieve, at the beginning of its exposure period, the voltage that it would develop at equilibrium when conducting the selected current. The precharge is preferably provided at relatively low impedance in order to minimize the time needed for the column to reach Vpr.

Figure 3:
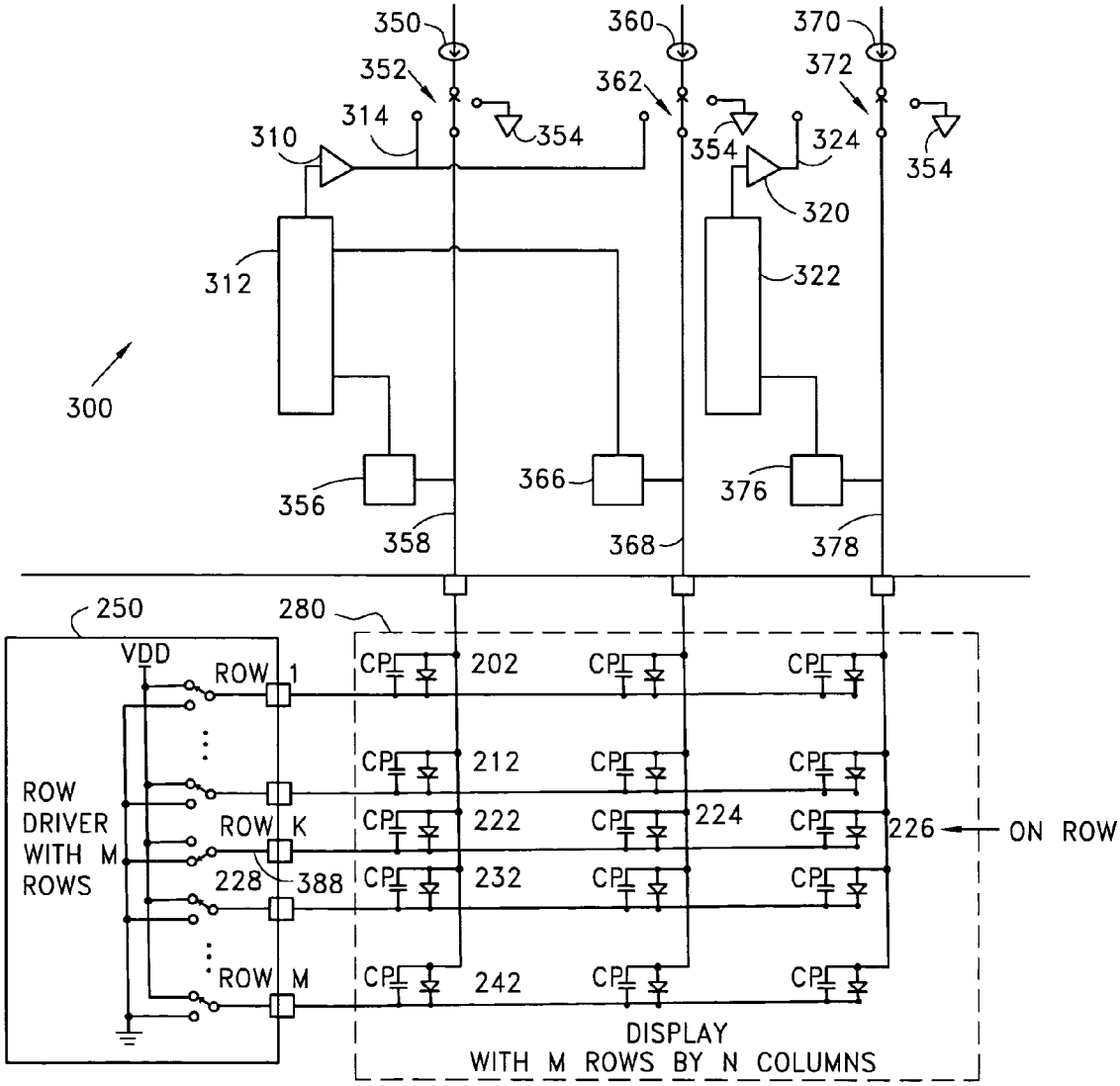
FIG. 3 is a schematic representation of elements involved in establishing a precharge voltage.

FIG. 3 schematically illustrates a circuit configuration for control and sampling of the voltage at representative column connections 358, 368 and 378. For each column connection, a switch 352, 362 or 372 connects the column to various sources at appropriate times. For example, during a precharge period, each of the switches 352, 362 and 372 may connect the column to a precharge voltage source output, such as 314 or 324. The switch position is shown during an exposure period, when a row drive switch such as 228 connects a row (K) to a drive voltage (e.g., ground), and when each column switch 352, 362 and 372 connects each column (if active) to the corresponding current source 350, 360 or 370. At the end of each column exposure period, the length of which may vary between columns, the corresponding column switch (e.g. 352) may connect the column to a column discharge potential 354. The column discharge potential may be ground, or may be another potential which is low enough to ensure rapid turn-off of the active elements.

Obtaining a Precharge Voltage

FIG. 3 illustrates, with a simplified schematic, how the precharge voltage may be obtained. First, a device conduction voltage may be sampled to obtain a conduction sample voltage Vcs. Column voltages Vcol, which are available in the column driver device 300 at column connections such as 358, 368 and 378, are good examples of such conduction voltages. Accordingly, in the present description Vcs is generally a sample of Vcol, but it should be understood that in many embodiments Vcs may be a sample of an alternative voltage, as is discussed subsequently. One or more such Vcs quantities may be used to affect or control the precharge voltage. Note that control may be derived in various ways from conduction voltages. For example, differences between Vcs quantities, or samples of conduction voltage ramps, may be used for this purpose, as is discussed with respect to FIGS. 8 and 9. However, direct control from Vcs values is illustrated first.

A sampling circuit 356, 366 or 376 may sample the voltage Vcol of any of the column connections, e.g. 358, 368 and 378, respectively, to obtain a Vcs for the column. Vcol for the column connection 358, if referenced to ground, may include the voltage produced on an element 222 (shown with both diode aspect and parasitic capacitance aspect "CP"), supplied from a current source 350 in a column driver device 300. The anode side of the element 222 is connected to the column connection 358 through a column trace of the matrix device 280, while the cathode side of the element 222 is connected to ground through a row line and the row drive switch 228. As such, Vcol of the column connection 358 includes a voltage caused by the current in that portion of the distributed resistance of the column trace which exists between the connection 358 and the element 222, and further includes a voltage produced by common currents through the impedance of the row line between the element 222 and a row K connection 388, as well as through the driver impedance of the row drive switch 228 (or from the row K connection 388 to ground). The common row currents may be the combined currents from the element 222 and any other conducting elements, e.g. 224 and 226. Thus, the Vcs from Vcol of the column connection 358 reflects other conduction voltages as well as the voltage developed across the element 222 by the column current source 350. A Vcs corresponding to any other column connection may be similarly obtained.

Column voltages Vcol, such as will be present at column connections such as 358, 368 and 378, are particularly described herein both to be sampled to obtain a Vcs and ultimately a precharge voltage Vpr, and also to be set by precharging. However, for some circumstances it will be useful to sample and/or control other conduction voltages that occur in the matrix element current paths. For example, a column-to-row voltage between column connections (e.g. 358) and row connections (e.g. 388) may be sampled, particularly if the row driver device 250 is packaged together with the column driver device 300. Such sampling may eliminate some variability in Vcs that is not due to a voltage developed across an element, and controlling the column-to-row voltages may more closely establish the desired matrix element voltages.

One or more Vcs (sample) values, obtained as described above, may be combined to affect or control a precharge voltage. For example, a single Ves from the sample device 376 may be transferred directly to a hold device 322, and thence applied directly to a buffer 320 that provides a precharge voltage output 324 for precharging the column through the switch 372. If the sample device 376 provides a digital representation, then the hold device 322 may receive and convert such digital representation to a voltage to input to the buffer device 320. The same effect may be provided analogically if the hold device 322 buffers the output from the sample device 376, and charges a hold capacitor in the hold device 322 to a hold voltage Vh that is an input to the buffer 320.

Samples may be combined in a number of different manners. One example is temporal combination: for example, the hold device 322 may combine an incoming Vcs with previous Vcs voltages to obtain a smoothed hold voltage Vh to apply to the buffer 320. Another example combines concurrent voltages; for example, a hold device 312 may combine Vcs from more than one sample device, e.g. 356 and 366, to provide an input to a buffer 310 for providing a precharge voltage 314. A third example combines concurrent samples over time; for example, the hold circuit 312 may not only combine different Vcs inputs with each other, but with previous voltages as well.

The precharge voltage output may be supplied to the column(s) from which it is developed and/or to other columns. In a typical case, as shown, the precharge voltage output 314 from the buffer 310 is provided, via a respective switch 352 or 362, to the same columns which provide the source for the Vcs upon which the precharge voltage is based. However, the precharge voltage output 314 need not be provided to the columns from which it is derived, and it may be provided to columns from which it is not derived.

Either (or both) digital or analog storage and combination techniques may be used to derive and store a precharge basis that reflects previous conduction voltages, such as Vcs values. Precharge voltages may then be based on the precharge basis. If the sample devices 356, 366 and 376 are ADCs providing a digital output, then the hold devices 312 and 322 (which may be internal to the buffers 310 and 320) will typically include a DAC to convert the outputs from the sample devices into analog form, with or without further adjustment of the values, to set the precharge voltage level. Such digital embodiments are well known in the art, and can be provided by the skilled person to effect wide ranging and flexible combinations of input and output voltages, at a cost of at least one ADC, at least one DAC, and some digital processing capability. Since digital sampling may be applied anywhere, analog techniques may be combined with digital techniques. Analog techniques for combining and storing Vcs values to provide precharge voltage are illustrated in FIG. 4.

Figure 4:
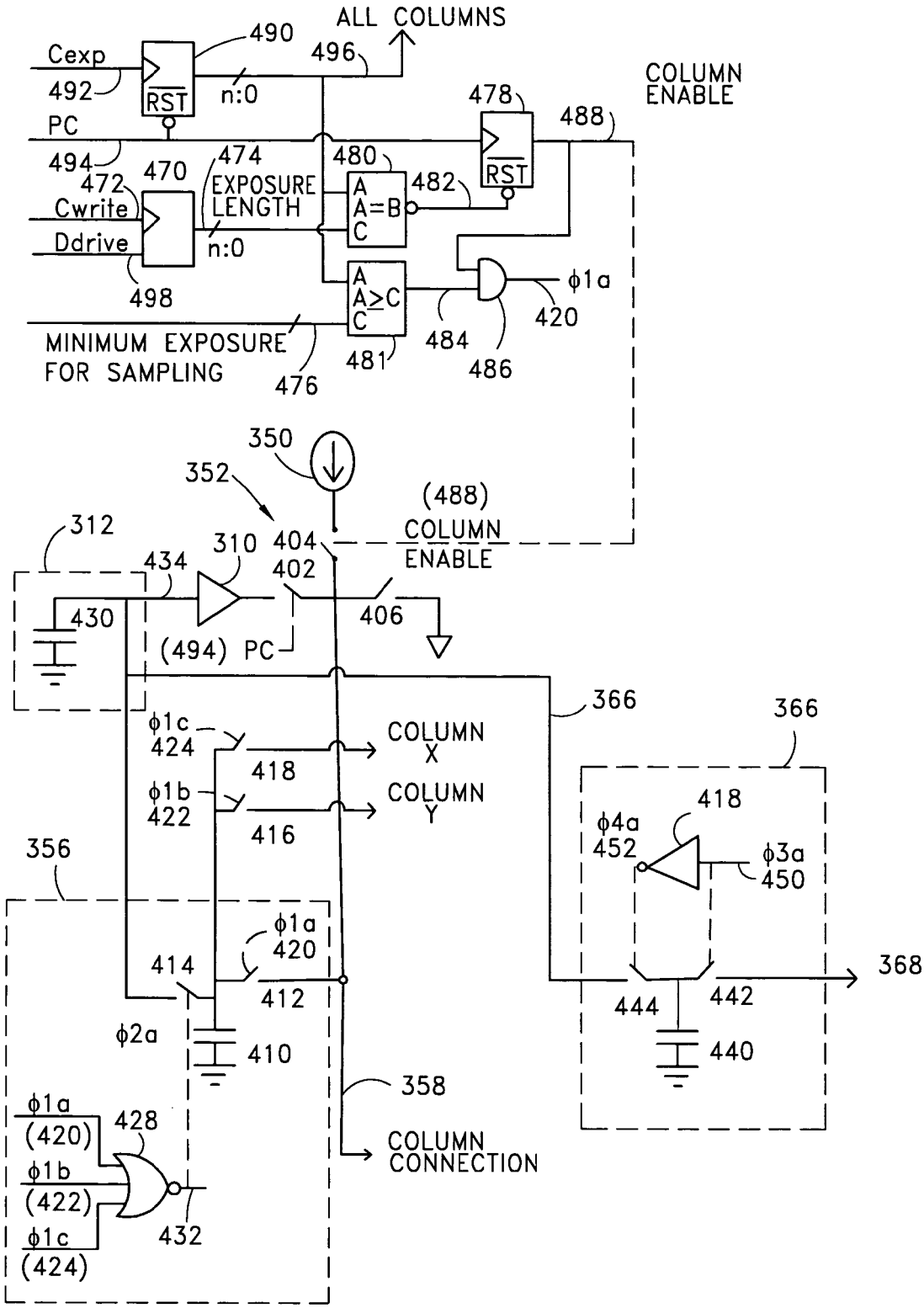
FIG. 4 is a simplified schematic diagram of circuit features for determining a precharge voltage and setting an element exposure length.

FIG. 4 is a simplified schematic representing some aspects of an analog device embodiment of a column driver such as the driver device 300 of FIG. 3. Simplifications include the use of mechanical switch symbols (e.g., 402, 404, 406, 412, 414, 416, 418, 442 and 444) to represent some electronic switches, control of which may be indicated by dotted lines from control logic signals. By convention, a true (e.g., "1") value of the control logic closes the switch. The level shifting and logic (which may include non-overlap circuitry) needed to cause such electronic switches to function in accordance with the mechanical representation are well known in the art, and will be readily implemented by the skilled person.

FIG. 4 illustrates, with sample circuits 356 and 366, two techniques for sampling a variety of column voltages. Sample circuit 366 illustrates use of a single sample circuit 366 with a corresponding single column connection 368. An alternative technique is illustrated with respect to sample circuit 356. With the inclusion of logic such as the NOR gate 428, and extra sample switches such as 416 and 418 to connect to other columns X or Y, sample circuit 356 in FIG. 4 shows additional details (beyond those in FIG. 3) whereby several different columns, such as X, Y and the column of connection 358, may be selectably sampled by the single sample device 356 in a manner which is not explicitly shown in FIG. 3. FIG. 4 thus illustrates an embodiment in which both techniques are used with different columns. Of course, a given design may utilize only the technique illustrated with the sample circuit 356, or only the technique illustrated with the sample circuit 366.

In the technique illustrated with sample circuit 366, each separate sample capacitor 440 is connected via a switch 442 to just one column connection 368 under control of a sample switch control signal Φ3*a* 450. A sample output switch 444 may be provided to connect the sample capacitor 440 to the hold device 312 under control of a second phase control signal Φ4*a* 452, which may be true whenever Φ3*a* is not true, as represented by an inverter 446. Φ3*a* and Φ4*a* may in general be false at the same time. The output from the sample circuit 366 is conveyed to the hold device 312 via the path 367, which in this case is a simple direct, single connection.

In the technique illustrated with sample device 356, a sample capacitor 410 may be used for sampling voltage on a variety of column connections. A sample output switch 414 may also be provided to connect the sample capacitor 410 to the hold device 312. The output switch 414 is controlled by a second phase logic signal Φ2*a* 432, and will typically be open whenever another switch is closed to the sample device 356, particularly input switches such as 412, 416 and 418. Thus, when the sample capacitor 410 in the sample device 356 includes switches such as 416 or 418 to sample extra columns Y or X, as shown, the control signal Φ2*a* 432 of the switch 414 is preferably true only when all of the sample switch control signals Φ1*a* 420, Φ1*b* 422 and Φ1*c* 424 are false. The representative NOR gate 428 implementing this function preferably includes non-overlap logic, such that the switches connected to the sample capacitor 410 are closed only at mutually exclusively times. The output from the sample device 356 may originate from different selected columns such as X, Y, or that of connection 358. The output is conveyed to the hold device 312 along a path 357, which in this example may be a simple connection.

The hold device 312 is shown as including a hold capacitor 430, and provides an output hold voltage Vh at a hold output connection 434, which is connected to the buffer 310. The hold device 312 may accept inputs from a number of sample circuits, as shown, via the sample output switch 414 for the Vcs on the sample device 356, and via the sample output switch 444 for the Vcs on the sample capacitor 440. More such sample devices may also be connected. Thus, present values from sample circuits such as 356 and 366 may be combined with each other, and/or combined with previous Vcs values, to achieve a hold voltage Vh at connection 434 for input to the precharge voltage buffer 310 to provide a precharge voltage Vpr for one or more corresponding columns. Previous values of Vcs are typically combined in a Vh, but if temporal averaging is not desired then it may be avoided, for example, by making the hold capacitor 430 small compared to the sum of sample capacitors (e.g., 410 and 440) that are connected to it. The sample output switches, such as 414 and 444, which provide switchable connection of any number of sample devices to a hold device such as 312, may typically be closed simultaneously. Thus, as shown, the hold device 312 may combine various samples, such as from the sample devices 356 and 366; and these sample devices may in turn obtain information from one or more different conduction voltages.

Particular embodiments may also employ just a single sample device, such as the sample device 356, with a particular hold device such as 312, in which case combining different sample values is not necessary. Such an embodiment may be convenient, for example, when all columns to be sampled for determining the precharge voltage from a particular buffer (such as the buffer 310) are switchably connected to the single sample device (e.g., via switches such as 412, 416 and 418).

Consistent with the above description, then, at least three different approaches may be used to obtain, and/or to combine, conduction voltage samples Vcs from any or all of the elements of a matrix, depending upon the needs of a particular design. In a first approach, which may be termed non-concurrent sampling, each column connection to be sensed may be switchably connectable to a sample device, which may be shared by all such "sensible" columns. In non-concurrent sampling, a conduction voltage is sampled for a single selected device at any one time, typically during a scan cycle conduction period, and the sample device is then connected to the hold element during a non-conduction period. Such sampling may be performed during successive scan cycles, so that previously sampled voltages are combined with the most recently sampled voltage to produce the hold voltage Vh on the hold capacitor. The extent of averaging will, of course, be a function of the relative size of the sample capacitor 410 and the hold capacitor 430. If the sample device performs digital sampling, or digital values are derived from the samples, then the combining function may be programmable, allowing great flexibility. For example, combined values from any selected groups of pixels may be used to control the precharge voltage.

A second approach for obtaining and combining conduction voltage samples Vcs may be called parallel sampling. Each column connection that can be sensed may be connected by a sample switch, such as 442, to a unique corresponding sample capacitor, such as 440. In this approach, the outputs from various sample devices, such as the sample circuits 356 and 366, are connected to a shared hold device, such as the hold device 312. There may be one or more separate hold devices like 312, each connected in turn to one or more sample devices, and each providing a precharge voltage reference to a buffer such as 310, the output of which provides precharge voltage to one or more column connections, such as 358 and 368. Thus, this approach can readily provide a number of different precharge voltages for distinct column groups. In a limiting case for this arrangement, all of the sample circuits (e.g., 366) for all of the sensed columns are connected via corresponding sample output switches (e.g., the switch 444) to a single hold device (e.g., 312). The hold device thereby provides a single hold voltage Vh to a buffer (e.g., 310) as a reference for a precharge voltage.

A third approach to obtain and combine conduction voltage samples Vcs may be called mixed sampling. The mixed sampling approach can also provide one or more precharge voltages Vpc for one or more corresponding groups of columns, as does the second or parallel sampling approach. According to the third approach, a number of columns (such as Column X, Column Y and the column connection 358) are each switchably connected to a shared sample device (such as 356) via a sample switch (such as 412, 416 or 418). It will typically be inconvenient to connect different active columns together, which may be avoided by ensuring that only one of such common-capacitor sample switches is closed at any given instant. For example, just one of the columns may be connected during a particular conduction period. Different columns may alternatively be connected to the sample capacitor at different times during a scan conduction period, particularly if the sample capacitor (e.g., 410) is connected to the hold circuit (e.g., via the switch 414) while all columns are disconnected. Such shared sample devices (e.g. 356) are typically connected via a corresponding sample output switch, such as 414, to a common hold device, such as 312, or to a digital conversion circuit. One or more sample circuits, whether shared like the sample circuit 356, or unique to a column like the sample circuit 366, may be connected to a common hold device, such as 312, such that the held value can reflect the column voltages sampled by such one or more sample devices. A driver device, e.g. 300, may have just one such hold device to provide Vh for all columns, or it may include a number of such hold devices. If more than one hold devices is used, then each hold device may control a Vpr for a corresponding group of columns.

The hold voltage Vh may be filtered. Vh may be based only on combinations of presently sampled Vcs values, but will more typically combine Vcs values from previous scan cycles to form a smoothed value. In digital embodiments, Vh may be filtered digitally to reflect any combination or function of Vcs samples from present and past scan cycles. In the analog embodiments explicitly represented in FIG. 4, the number of sample device outputs combined into a particular hold device may control filtering. For example, if four sample devices like 356, each having a sample capacitor like 410 of the same value, are connected into a hold device having a hold capacitor 430, then filtering generally occurs as a well-known averaging function of the relative capacitor values. In one embodiment, each sample device includes a second phase switch, such as the switch 414 or the switch 444, and all of the second phase switches are closed during a non-conduction period of the sampled elements. Accordingly, the resulting hold voltage Vh will be determined by the previous Vh value in combination with an average, Vcsa, of the four sampled Vcs values. Given a sum of all the sample and hold capacitor values Csum, including a sum of the sample capacitors Csamp and a hold capacitor value Chold, the new Vh (Vh (z+1)) will be the old Vh (Vh (z)) combined with Vcsa. In particular, $$Vh(z+1)=Vh(z)[Chold/Csum]+Vcsa[Csamp/Csum] \quad \text{Eqn. 1}$$

Thus, in this case a proportion Chold/Csum of the new Vh is due to the old Vh, and a proportion Csamp/Csum of the new Vh is due to the present Vcsa. If Csamp/Csum is more than about 25%, Vh will substantially track the recent Vcsa, and thus the precharge voltage will substantially track changes in the precharge voltage due to the varying column resistance seen by the different rows. Conversely, if Csamp/Csum is substantially smaller than 25%, the present Vcs will have less effect on the next Vh, and the precharge voltage will be less able to follow changes in Vcs from row to row. For longer term averaging, Chold may be about 20 to 2000 times Csamp, and may be fabricated external to a device driver integrated circuit. For rapid tracking, Chold may be about 0.3 to 3 times Csamp. Values between or outside these ranges may also be used, depending upon the application.

As an example, if four sample devices each having a sample capacitor of a value 1 pF are combined into a hold device having a hold capacitor of 8 pF, the next Vh would be based 33% upon the present average of Vcs values, and the precharge voltage would substantially track progressive changes in conduction voltages from row to row.

In order to individually control a quantity of charge delivered to each device in a matrix, an exposure period (see 560 of FIG. 5) of variable duration may be provided for each column during each scan cycle. FIG. 4 also illustrates circuitry, which may be fabricated as part of the driver device 300, for controlling such variable exposure durations.

A precharge signal PC 494 may be provided to reset a counter 490 during a precharge period prior to an exposure period. Upon termination of the precharge period, the PC signal 494 may set a latch 478 such that an output "Column Enable" 488 enables a switch 404 to provided column exposure current to the column connection 358 from the current source 350. The signal PC (precharge timing) 494 may be provided for the entire chip, or may be established for a group of one or more columns.

In order to control the termination of exposure current, exposure duration information may cause reset of the latch 478. An exposure clock Cexp 492 may be provided, the period of which determines the minimum exposure period. A counter 490 may count the exposure clock edges and output n+1 bits representing a current exposure count 496 to some or all of the individual column drive circuits. The n+1 bits of exposure count 496 may be provided to all columns, or alternatively some columns may generate separate exposure counts. Particularly when provided to many or all columns, such exposure count need not be uniform, but may provide a varying time between successive exposure counts to provide varying steps between exposure levels without a need for excessive data bits to represent such exposure levels. The exposure count 496 may be applied to input "A" of a logic circuit 480.

N+1 bits of exposure drive data Ddrive 498 may be provided for the particular column, e.g., 358, to a register 470. The Ddrive data 498 may be provided serially and shifted into a shift register 470, or may be provided on a parallel bus and be latched into the register 470 under control of a write clock Cwrite 472. The output 474 of the register 470 may be n+1 bits of parallel exposure length data, which may then be provided to input "B" of the logic circuit 480. The logic circuit 480 may compare the exposure length data 474 on input "B" with the current exposure count value 496 on input "A" and provide an output 482 which, when A and B are equal, resets the latch 478. The "Column Enable" signal 488 is thus negated, and will cause the exposure current switch 404 to open and also, typically, will initiate discharge of the controlled column (e.g., 358) through discharge circuitry such as a column discharge switch 406.

An output 420 of an AND gate 486 may be the signal Φ1*a* 420 to control the sample switch 412. A logic device 481 may provide further logic for controlling the signal Φ1*a* 420. It may be employed to preclude sampling a Vcol for a column which has a conduction period shorter than the minimum exposure value 476, for example by preventing connection of a Vcol to a sample capacitor until the end of the minimum exposure period, thus permitting some settling of Vcol as discussed below with respect to FIG. 5. To effect this, the value of minimum exposure for sampling 476, typically represented by less than (n+1) bits, may be provided to a "C" input of the device 481 such that an output 484 is true only when the Exposure Count value 496 on input "A" is at least as great as the input "C." Signal Φ1*a* 420 may be prevented, until such time, from causing the column 358 to be connected to the sample device 356. The input "C" may be hardwired, or made selectable. Minimum sampling exposure may alternatively be controlled by a minimum exposure signal, which is low until a selected period after the end of the precharge signal PC 494. Such a control line may be provided directly to a number of column control circuits, and may be connected to the input 484 of the AND gate 486 without any need for the logic device 481. In general, an almost unlimited variety of electronic device arrangements and logic may be employed to control a column drive device as taught herein.

The sample switch control output Φ1*a* 420 is true only if the column enable 488 is also true, as indicated by the AND gate 486 which provides Φ1a 420. The column enable output 488 from the flip-flop 478 controls the switch 404 which connects the current source 350 to the column connection 358, and thus directly controls the exposure time. The column enable 488 is set at the end of the precharge period, and is reset when the exposure count 496 "A" is equal to the selected exposure length "B."

Control for the column discharge switch 406 is not shown. The switch 406 is preferably closed after the end of the column enable 488, as long as the precharge switch 402 is not closed. In view of the substantial parasitic capacitance of the columns when the rows are connected to an AC ground, the column discharge switch may control the actual termination of conduction by the matrix element. In such case, the exposure switch 404 may be opened either somewhat before or somewhat after the discharge switch is closed, though typically the transitions will be nearly concurrent.

A selectable column sample group is a number of columns that are connectable to a shared sample device (such as the sample device 356) via a corresponding number of first phase switches (such as 412, 416 and 418). In the typical low-impedance circuits, such samples are typically separated by time. A single member of such selectable column sample group may be selected during a particular scan cycle, for example that column of the group which has the longest exposure time, i.e. the column for which the exposure length value (e.g. 474) is largest. Alternatively, however, differences in exposure times between selectable column sample group members may be utilized to permit sampling voltages from more than one of such selectable columns during a single exposure period. One implementation of this alternative selects, first, the shortest exposure length value that exceeds a minimum value. At the end of exposure for this first-selected column, its first phase switch may be opened and the second phase switch (e.g., 414) closed to the hold device 312. After sufficient settling time, the second phase switch 414 may be opened and another first phase switch closed to a column having an exposure time sufficiently long to permit establishing an accurate sample voltage on the sample device (e.g. 410). This time-multiplex process may be repeated several times during a scan cycle to average a number of different Vcs values using a single sample device. It may be performed as a variation of the first "non-concurrent" sampling approach, or as a variation of the third "mixed" sampling approach, both of which are discussed hereinabove.

Applying Precharge in Normal Operation

The stored value Vh on a hold device may be used as a basis for precharging the parasitic capacitance of columns to a precharge voltage Vpr at the beginning of exposures. In particular, as shown in FIG. 4, Vh may be a reference input to a buffer, such as the buffer 310, which provides a precharge voltage Vpr at reasonably low impedance to one or more columns, e.g. the columns 358 and 368 of FIG. 3. Vpr may be simply the value of Vh, or may be adjusted with an offset voltage (discussed further below) to provide an adjusted Vpr for the particular column or columns. Offsets may be useful, for example, when some elements have more column and/or row resistance to the drivers than other elements. The different voltage losses due to the connection resistances may be measured or predicted, and based upon the selected current a Vpr difference due to such connection resistances may be calculated. Transient errors may also be anticipated, as discussed further below, and Vpr may then be adjusted to compensate for the anticipated conduction voltage differences and transient errors.

Figure 5:
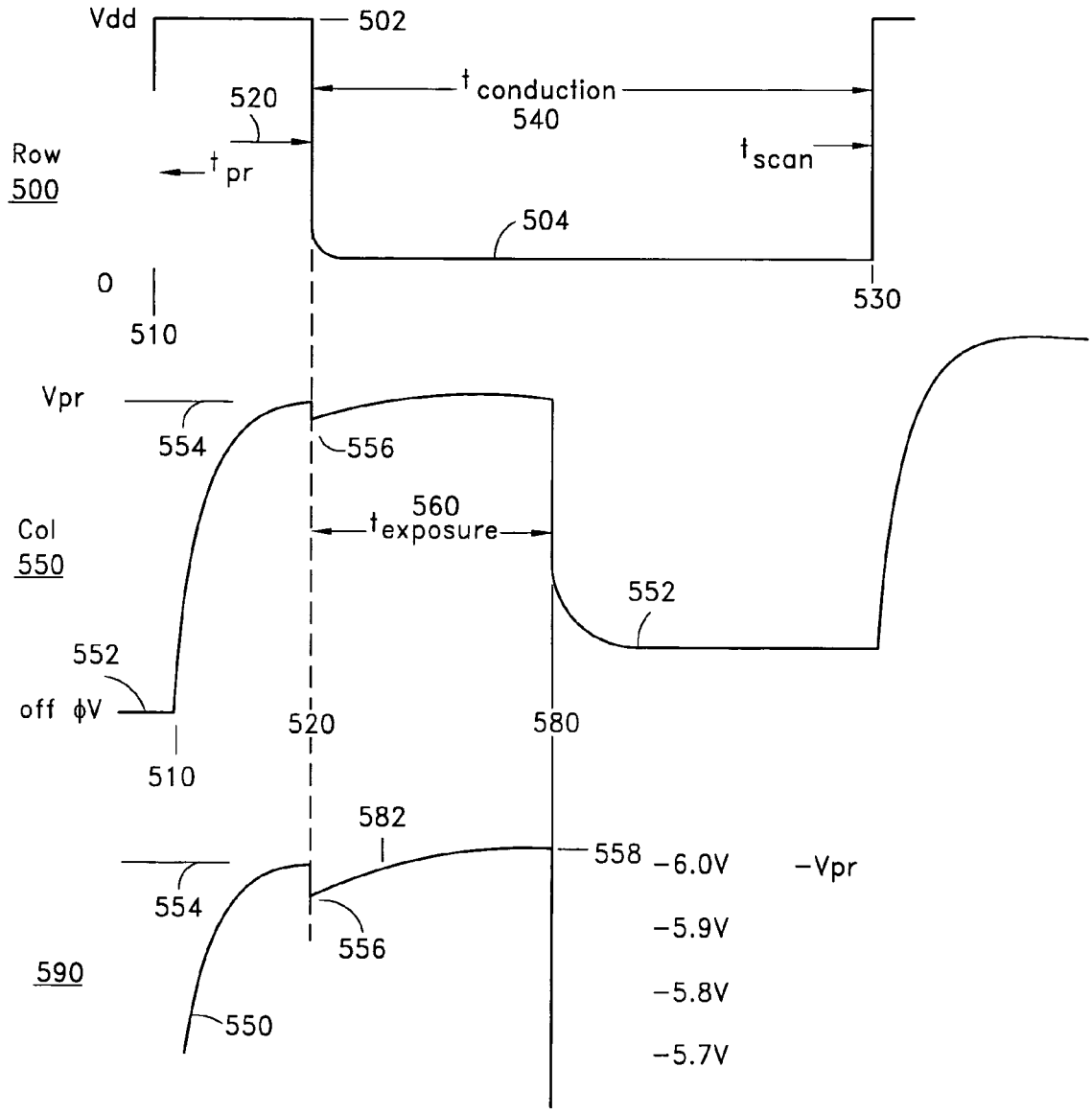
FIG. 5 is a representation of voltage values during a scan cycle.

FIG. 5 shows a representative voltage waveform 500 for a row, and a voltage waveform 550 for a column, during a single scan cycle. A voltage waveform 590 shows an expanded detail of the column voltage 550. The scan cycle begins at a time 510. At that time the row voltage (trace 500) is raised to a level 502, which is the row "off" voltage Vro. A scan cycle may be divided into a precharge period 520, during which the row voltage 500 is high so that devices do not conduct, and a conduction period 540 during which the row voltage is set to conduction level 504.

Referring also to FIG. 3 for exemplary elements associated with the timing illustrated in FIG. 5, the row switch 228 connects the Row K connection 388 to a row "off" voltage (Vro) level 502 (labeled Vro 302 in FIG. 3) at a time 510 at the beginning of the scan cycle for the row K. Note that Vro may be selected from a range of voltages, depending upon the particular application, and also upon present conduction voltages. Vro will generally be set in a range from the upper supply voltage, Vdd, to a voltage that is lower than Vpr by a "subconduction" amount. The subconduction amount is slightly less than enough to cause significant conduction in a matrix element or LED, and thus devices whose cathode is connected to Vro are prevented from conducting significantly when the corresponding column drive source is active. The voltage of the columns is limited so as to preclude significant conduction of matrix diode elements when the row is raised to Vro. Vro may also be somewhat higher than Vpr, so long as when the column voltage is dropped back to the off voltage 552 at a time 580, the reverse breakdown voltage of the diode elements is not exceeded. In some embodiments, Vro is set to the same value as Vpr. Just before the time 510, the column voltage 550 is typically set to the column "off" voltage value of 552. This "off" value may be zero, near zero such as 100 mV or 200 mV due to driver voltage of the circuit elements forming the switch 352, or may be a different value which is preferably low enough to preclude significant conduction by the matrix element diodes when the rows of the elements are driven to their sink voltage. After these preliminary considerations, the scan cycle actually begins with a precharge period.

The precharge period is initiated, at time 510, when the column control switch 352 of the column driver 300 switches the corresponding column connection 358 from the column "off" voltage source 354 to the precharge voltage source 314. Accordingly, the column voltage 550 rises from the "off" voltage 552 to the Vpr voltage 554. The exact waveform will vary from element to element, depending upon the drive circuit resistances and the total parasitic capacitance connected between the column connection 358 and any other point that has low transient impedance to ground (such as the supply Vdd). The connection at switch 352 between the column 358 and the Vpr source connection 314 may be terminated any time after the column has achieved the desired precharge voltage. The waveform of the voltage 550 is expanded in a detail 590, showing the preferable condition that the voltage 550 of the column reaches Vpr 554 before the end of the precharge period. The end of the precharge period may be defined to coincide with a beginning of the conduction period 540 at time 520.

The duration of the precharge period, Tpr, depends upon several factors. Each selected column has a distributed parasitic capacitance and a distributed resistance, which will affect the time required to achieve the full voltage on the driven element. Moreover, the precharge buffers have certain impedances that are common to all of the columns they are driving, and their effective impedance will therefore vary. For example, if the buffer 310 is driving many columns, all of the elements of which are selected in a particular row, then the load seen by the buffer 310 during precharge may include many parallel column loads. A typical device, having for example 96 rows and 120 columns, might have a column resistance of about 1 K ohms, and a column parasitic capacitance of about 2400 pF. The precharge time constant ($\tau$) in this case will be greater than about 2.4 $\mu$S. To avoid significantly raising this $\tau$, the impedance of the buffer 310 preferably does not raise the circuit resistance by more than about 10%. Thus, the buffer impedance is preferably less than 100 ohms divided by the number of columns driven by the buffer. If a single Vpr buffer drives all columns of a 108-column display as described, then the buffer impedance is preferably less than 1 ohm. Such impedance increases the time constant to about 2.64 $\mu$S. Generally, given a precharge time constant $\tau$, it is preferred to continue precharge for at least three times the length of $\tau$, or in the present example about 8–10 $\mu$S. The precharge duration may be reduced to below three time constants, particularly if the precharge voltage is adjusted to compensate for the incomplete charging of the column voltage.

If a single precharge voltage buffer, such as 310, is used for many or all of the columns driven by the driver 300, it may be advantageous to provide a capacitor from Vpr to ground, the capacitor having a value of about one hundred or more times the parasitic capacitance sum of all of the driven columns, though smaller capacitors may be used effectively under some circumstances.

After the precharge period, a conduction period ensues during which matrix devices may conduct. Each matrix device (e.g. the LED of the element 222) is intended to conduct during its specific exposure period (e.g. exposure period 560), which is typically only part of the conduction period 540. At approximately the beginning of the exposure period 560, which begins at the time 520, the switch 352 connects the column 358 to the current source 350. At the time 520 the row switch 228 connects the row connection 388 to a row drive voltage 504, which may be as low as possible, for example less than 100 mV, or may be set to a low known voltage, such as 200 mV. Switching to a drive voltage permits the device 222 to begin diode conduction, creating light emissions or "exposure."

Switching the row voltage also causes transient effects on the column voltage. The row voltage switch action applies a step input Vstep to the parasitic capacitance of the element 222. The size of Vstep will be the difference between Vro (502) and row drive voltage (504). Charging the parasitic capacitance of the element 222 by Vstep will reduce the column voltage 550 to a value 556 which may be reduced from Vpr (554) by Vnotch=Vstep/N, where N is the number of parasitic capacitors of the same size which are connected together to the column connection (e.g. 358) and which are also connected to the transient ground, as explained above. 96 rows were assumed in the example discussed above, and all are connected to Vro, which is a transient ground. In such case, N is typically 96. Thus, if Vro 502 is 6 V, and Vdrive 504 is 0 V, then Vnotch is about 62.5 mV, and the column voltage 550 at 556 is about Vpr−Vnotch. Vnotch is increased when less rows are connected, such that N is reduced. The actual size of Vnotch will be affected by the speed of Vstep, and by the distributed R-C effects of the matrix connections.

The column drive will also be active for elements that are to be exposed during the conduction period. At the end of the precharge period at time 520, the column drive switches 352, 362 and 32 may switch each selected column connection (e.g. 358, 368 and/or 378) to the column current sources (e.g. 350, 360 and/or 370, respectively) for the remainder of an exposure period for the selected elements. Any or all of the elements (e.g. 222, 224, 226) of a scanned row (e.g. Row K) may generally be driven for an individually specifiable exposure period during the scan of that row.

In order to obtain an accurate value when a Vcol is sampled to obtain a Vcs, it will be helpful if the Vcol has reached steady state value at least by the time that Vcol is sampled. Moreover, if Vcol cannot settle quickly in an exposure period then the exposure current is likely to be incorrect. Vpr, as explained above, may be set from previous conduction values. In FIG. 5, the voltage 558 to which the column voltage 550 rises during the exposure period 560 for the element 222 is shown to be somewhat higher than Vpr. The exposure period 560 may be about 20 $\mu$S wide, and the current source 350 may be about 100 $\mu$A. As explained previously, such a current source may be able to drive a parasitic capacitance of about 2400 pF at 42 mV/$\mu$S. However, diode conduction limits the current available, and accordingly the rate of charge is much slower near the conduction voltage. Accordingly, as shown, the Vcol at a time 580 when the exposure is terminated may not have settled to a steady-state value. Prior to the time 582, the Vcol 550 (as shown in the expanded trace 590) is actually less even than the Vpr 554. Even after the time 582, the column voltage may not completely reach the steady state value of the conduction voltage, but it will be progressively closer as exposure period 560 extends.

Each individual element may generally be turned off at a different time during the scan cycle of the element's row, permitting time-based control of relative light output from each element. At time 580, the end of the exposure time for the element 222, the column connection 358 may be disconnected from the current source 350 and reconnected to the column "off" voltage 354 so as to rapidly turn off the element. Accordingly, the column voltage rapidly drops to the off voltage 552.

After one element (e.g. 222) turns off, other elements (e.g. 224, 226) attached to the Row K connection 388 may continue to conduct as long as other columns (e.g. 368, 378) are driven and the row voltage 500 remains at the drive level 504. The conduction period ends when the row drive switch 228 in the row driver device 250 connects the row connection 388 back to Vro 302 (FIG. 3), precluding further conduction by any elements. This switch may occur at the end of the scan cycle, which is the beginning of the next scan cycle precharge period, or it may be done at the end of the exposure time for the last element remaining "on" in the scanned row.

Offsetting the Precharge Voltage

The voltage achieved across a current-driven device by applying a precharge voltage to a column connection may differ from that which is intended. When the precharge voltage Vpr is based upon previously measured element conduction voltages, it is typically intended that the voltage of the presently driven device match the voltage(s) of the device(s) upon which such previously measured voltages were based. At least two factors may interfere with such matching. The first factor includes transient errors, such as Vnotch, explained above with respect to FIG. 5. Incomplete charging of Vcol due to a short precharging period may be considered another transient error, and may lead to a further transient error when the current from the Vpr buffer (e.g. 310) is terminated while still at a relatively high level (particularly when the column voltage is below the final conduction level). Substantial charging current will cause a voltage drop across the column resistance between the column connection (e.g. 358) and the actual precharged element voltage stored on the distributed parasitic capacitance of the column. Accordingly, the actual element voltage will be lower than the voltage at the connection (e.g. 358), presumably Vpr. (Of course, if the charging current at the termination of the precharge period is equal to the conduction current, this "error" may precisely offset column voltage loss during exposure.) Second, in addition to transient errors, errors may be caused when the conduction voltages Vcs vary between the measurement condition and the precharge condition. Since the actual matrix device voltages often cannot be directly measured, the conduction voltages (e.g., Vcol) that are measured as Vcs are likely to include voltages that are largely independent of conduction by the element in question. Thus, for example, Vcol may vary due to varying cumulative currents through common row and row driver impedances. To the extent that such non-device voltages vary between the Vcs upon which precharge is based, and the time when Vpr is delivered to the column, errors will be introduced to the voltage to which the element is driven.

Because Vpr is typically applied to Vcol only until the end of the precharge period, changing the precharge voltage that is provided from the buffer 310 may compensate both transient errors and conduction voltage discrepancies. There are many possible means for providing such offsets, some of which are discussed further below. In a digital precharge circuit, in which the output of the precharge buffer (e.g. 310) is digitally controlled, the value of the precharge digital input number may be modified appropriately. An analog precharge control circuit, such as described with respect to FIG. 4, may be compensated by inserting an offset, which may be digitally adjustable, in series with the input of the buffer, e.g. 310.

Figure 6:
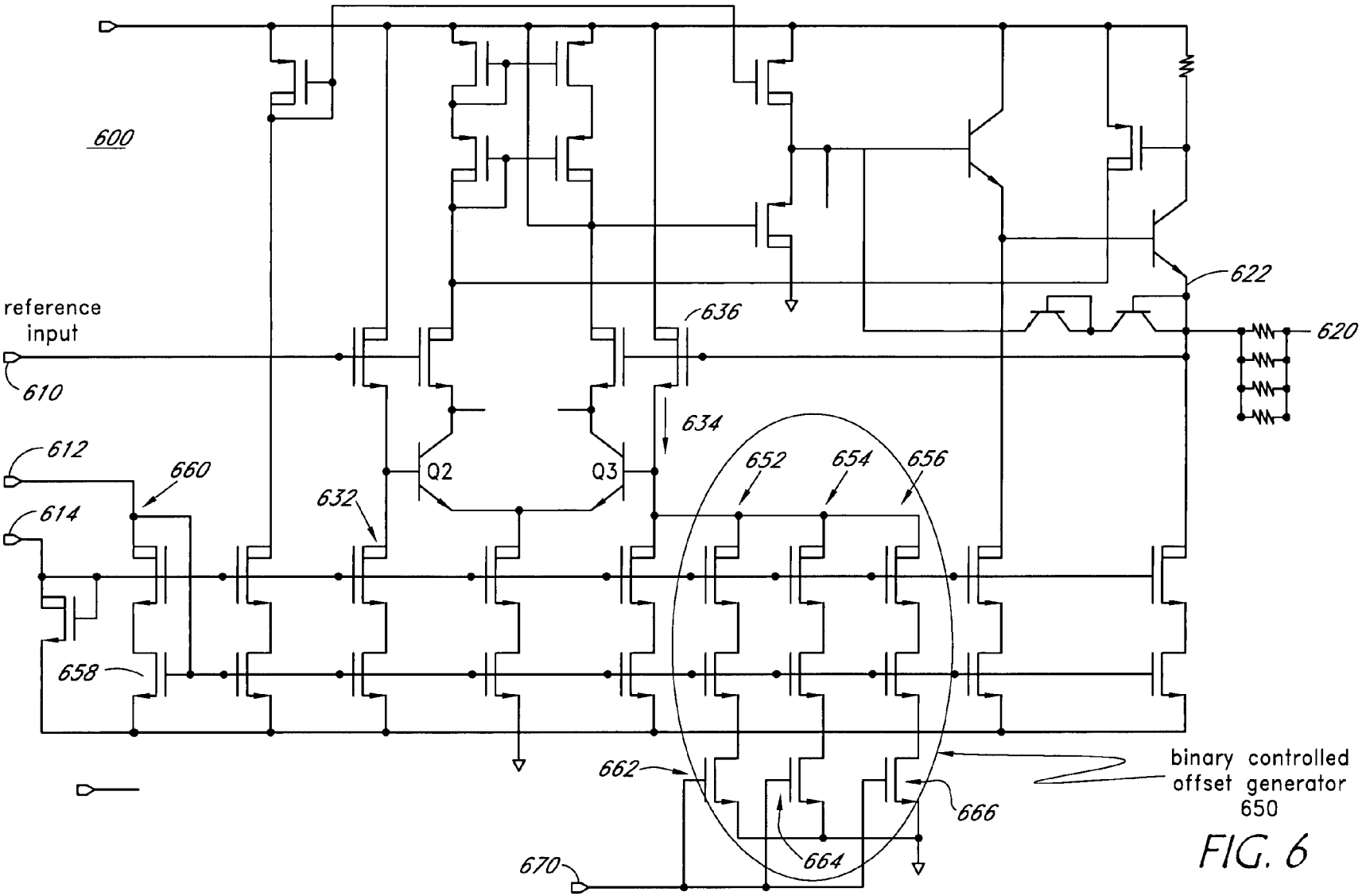
FIG. 6 is a schematic diagram of a precharge voltage buffer with an offset circuit.

FIG. 6 shows an exemplary circuit for a Vpr buffer 600, such as the buffer 310, including a digitally adjustable offset circuit 650. The buffer 600 is generally a conventional design having a voltage input 610 connected to a first side of a differential amplifier stage. Current inputs 612 and 614 may be used as enables or to scale the drive currents. An output 620 is connected through a limiting resistor to the second side of the differential amplifier stage, 622. Any differences between current 632 through the first side differential input FET and current 634 through the second side differential input FET 636 will cause a difference between the voltages at 610 and 622, presuming the two differential input FETs as well as Q2 and Q3 are matched. Such current difference, divided by the input FET transconductance, establishes a difference in Vgs between the input FETs that establishes the difference between the voltage 622 and the voltage 610. Such a current difference may be established, for example, by means of a digitally controlled offset current circuit 650.

In the offset current circuit 650, current sources 652, 654 and 656 may be set, through size selection relative to the transistors in reference current mirrors 658 and 660, to have currents which are related to each other such that, for example, the current of the source 656 is twice that of the source 654, which is twice that of the source 652. The total current in that event, all sources conducting, is seven times the current in the source 652. Thus, the current in the source 652 should be set to be 1/7 as much as will cause the maximum offset desired, given the transconductance characteristics of the second differential FET 636. It should be noted that though the offset generator is designed to increase the voltage at the output 620 compared to the voltage at the input 610, the polarity may be shifted by placing a current source similar to the source 656 so as to increase the current 632, or by many other techniques. A positive-only offset is shown to be unidirectional in order to compensate for the Vpr errors described above, which tend to cause Vcol at the beginning of the exposure to be low, but in other circuits Vpr errors may be reversed, such as when system polarities are reversed.

To control the offset generator 650, a data bit bus 670 having one bit for each of transistors 662, 664 and 666 may be provided. The least significant bit may control the transistor 662 which in turn enables the smallest current source 652, an intermediate bit may control a transistor 664 which enables the source 654, and a most significant bit may control a transistor 666 to enable the source 656. The number of sources and corresponding control transistors may be varied to provide more or less resolution on the offset value produced, and the current values need not be related as binary numerical values, but may for example set ranges of control if a largest current source, e.g. 656, is substantially more than twice the intermediate current source. The skilled person will understand that the ranging of such offset may be designed as a matter of engineering expedience, depending upon the offset ranges desired for the circuit.

Though an example of digitally controlled precharge voltages is described above, the skilled person will be able to design an unlimited number of different circuits for setting such voltage offsets, depending upon engineering and even aesthetic considerations, while remaining within the scope of the inventive ideas described above. For example, offsets may be disposed in different parts of the circuit, and need not be disposed at the input of a Vpr buffer (e.g. 310), but could be established, for example, in a sample circuit such as 356, or in a storage circuit such as 312.

Offsets to Vpr may also be used to compensate for other conduction voltages. For offset circuits that are digitally adjustable, such as the above-described circuit, a separate register may be provided to separately control each Vpr buffer circuit. This is particularly useful when significant differences in Vpr are needed for different groups of elements, such as groups at different distances from the connection to the row driver, e.g. 250. Such different distance may cause significantly different row conduction voltages on the row-connection side of the elements of one group as compared to another. For example, the element 226 in FIG. 3 may be connected to the row connection 388 by a significantly longer row connection than the element 212. Presuming that there are many other intervening elements between the near element 222 and the far element 226 which are conducting during a particular scan cycle, there is considerable common current flowing in the resistance of Row K, which will cause a row voltage difference between the first and last elements 222 and 226. Further presuming that a single Vpr is provided for all columns, the resulting row voltage difference between the two elements will diminish the voltage delivered to the far element 226 as compared to the voltage delivered to the near element 222 (the common voltage of the row connection, e.g. 388, will diminish both element voltages equally).

If separate Vpr drive circuits are provided for near and far columns (or other column groups), such row voltage error can be compensated with circuits such as shown in FIG. 6. A small current source may be provided for each column (or each group of columns) and calibrated to approximately correspond to a total voltage present at the row side of the corresponding elements when such element (or group) is conducting by itself. The current for near and far columns/groups may be linearly related between a minimum at the nearest column/group and a maximum at the farthest column/group. The current may be enabled to flow into a common sensing line for those columns (or groups) whose exposure registers indicate that the column will conduct for some minimum portion, for example ¼, of the conduction period (or, for a group example, that ¾ of columns in the group will be conducting for such a minimum exposure portion of the conduction period). The minimum exposure portion that enables particular current sources may be adjusted in accordance with average exposure levels. The enabled currents may then be combined and converted to a digital value proportional to the current, and scaled to reflect the total row voltage caused at the farthest column or group by such conduction. Columns or groups of columns having a unique precharge voltage Vpr and offset voltage may be designated "Vpr column groups." A digital row-voltage value may be selected for each such Vpr column group, after being selected via a lookup table or calculation to be a certain proportion of the total row voltage. The certain proportion may be the row voltage of the average column of the particular Vpr column group, when all columns are conducting, as a proportion of the maximum row voltage. This approximation will be adequate for most purposes, though precise calculations may be made by other means if required, to determine a conduction offset value to be provided for each Vpr column group. The determined conduction offset value may then be added to any offset value selected for the particular Vpr column group for other purposes, thereby creating a group offset sum. The group offset sum may then be disposed in the offset compensation register that controls the offset compensation circuit of the particular Vpr column group, thereby compensating the next precharge voltage.

It should be noted that if each Vpr is determined separately according to column voltage samples (Vcs) from columns within the corresponding Vpr column group, then row voltage compensation may not be needed, since the individual Vcs will, on average, reflect the row voltage for the Vpr column group. Also, Vpr offsets as described above may optionally be used in conjunction with the Vpr adjustment techniques discussed below, particularly to compensate for row and column connection voltage variations between elements, or if a particular implementation is affected by transient or other offset errors.

Adjusting Vpr to Achieve Consistent Vcol

Vpr may be derived from Vcol measurements (or from other conduction voltages) in other manners than those described above. For example, Vpr may be adjusted to reduce differences between Vcol early in exposures and Vcol late in exposures. Referring for a moment to FIG. 5, Vcol 550 is shown rising from the voltage 556 at the time 520 when exposure conduction begins, to the voltage 558 at the time 580 when exposure conduction is terminated. Ideally, precharge initializes the column voltage to an equilibrium value for the presently selected exposure conduction value so that conduction current is correct throughout the duration of exposure conduction. While conduction current that is constant (on average) is applied, Vcol will move toward the equilibrium voltage (if it does not start at that value). This presents an opportunity to determine the accuracy of the precharge voltage by comparing Vcol at "early" times of exposure conduction to Vcol at "late" times of exposure conduction. One technique for such comparison determines a representation of one or more "early" exposure conduction Vcol voltages and a representation of one or more "late" exposure conduction Vcol voltages, and adjusts the precharge voltage Vpr to minimize any difference between these representations.

Figure 7:
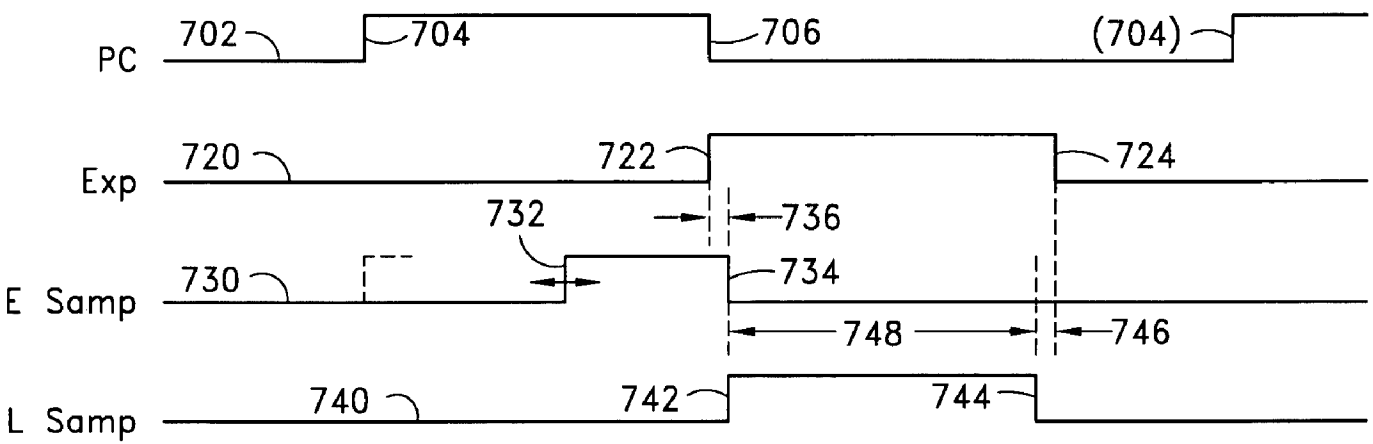
FIG. 7 is a signal timing diagram for circuit control signals.

Before turning to a circuit for implementing the foregoing comparison technique, reference is made to FIG. 7, which illustrates signals that may be generated to establish "early" and "late" timing. The skilled person will be able to generate switch actuation signals based upon such timing by numerous means. For example, a counter value of n bits may be provided in common to each column driver circuit (comparable to 264 in FIG. 2), and a data value of n bits, unique to each column driver circuit, may be provided to the corresponding driver either as static data on an n-bit bus, or as serial or parallel data for latching at the column driver. The counter value may be compared to the data value to generate a signal representing a time, which may then set or reset a latch.

A precharge signal PC 702 may be sent globally to all column drivers. A scan cycle may be defined, for convenience, as extending from the beginning of one precharge period 704 to the beginning of another precharge period 704 (which begins a scan cycle of a different row). PC 702 going true may cause Vpr to be applied to a column connection at a precharge initiation time 704, and may also cause Vpr to be disconnected from the column connection at a time 706. The time 706 of disconnection typically precedes exposure conduction 722. An exposure signal Exp 720, which preferably may be uniquely set for a particular column drive, may become active at a time 722. The time 722 is preferably slightly later than the precharge termination time 706, but could be the same time, or could even precede the time 706 such that precharge and exposure overlap to some extent. Typically, a row drive switch for the row being scanned is switched to drive voltage (e.g., a low voltage for the device polarities illustrated) when the signal Exp 720 becomes active. The Exp signal 720 becomes inactive again at a time 724, at which time a column driver switch is generally disconnected from an exposure current drive source, and is connected to an "off" or discharge voltage.

An early sample signal ESamp 730 may be made active at a time 732. As indicated, the location of the time 732 may be varied, typically beginning by the beginning of the scan cycle at the time 704, and preferably sufficiently before an ESamp end time 734 at which the signal becomes inactive, such that a sample capacitor controlled thereby has adequate settling time to achieve its intended voltage level. The ESamp end time 734 typically defines the moment in time of an "early" sample, and is preferably selected to follow the beginning of exposure (at the time 722) by a delay time 736. The delay time 736 may, for example, be from ¼ to 4 $\mu$S. The delay time 736 may also take on larger values. It may also be made variable, and for some purposes the delay time may be zero or even slightly negative. A preferred delay 736 is just long enough to allow settling of transients at the beginning of exposures.

A late sample signal LSamp 740 may be made active at a time 742, which precedes a time 744 when LSamp is made inactive. Typically, the timing of early samples will be defined as the time 734 when ESamp is made inactive, and late samples may be similarly defined as occurring at the time 744 when LSamp is returned to the inactive state. The time 744 may therefore sometimes be referred to as the late sample time. Such late sample time is conveniently defined either with respect to the time 724, which it preferably precedes by a time 746 sufficient to avoid transients at the end of the exposure period, or with respect to the time 734 when that time defines the early sample time. In the latter case, the sample time difference 748 is selected and defines the location of the time 744. The time 742 is not critical as long as LSamp is active long enough to ensure accurate sampling, and may be conveniently set to be just after the time 734. Some of these signals shown in FIG. 7 may be used to control the circuits of FIGS. 8 and 9, as will be discussed below.

Nulling Early and Late Voltage Differences

Figure 8:
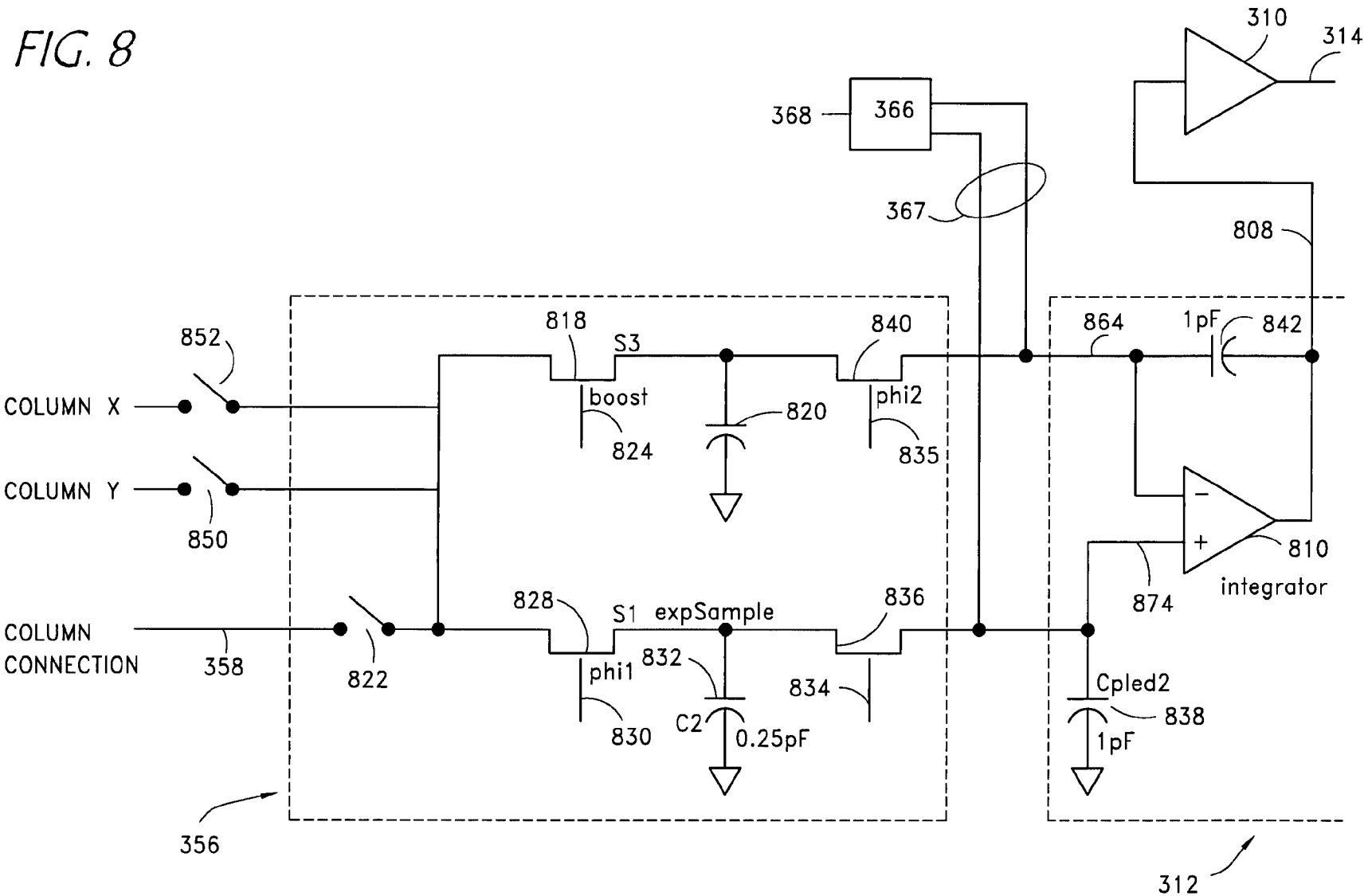
FIG. 8 is a simplified schematic of details for use with the circuit of FIG. 3 to adapt a precharge voltage in response to differences between early and late conduction voltage samples.

FIG. 8 is a simplified schematic representation of a circuit that adjusts Vpr based on a comparison between "early" and "late" Vcol voltages. Differences between "early" measurements and "late" measurements may be used to adjust Vpr without a necessity of adjusting it to be a fixed voltage based directly on from any particular conduction voltage. In the circuit of FIG. 8, the difference between such "early" and "late" voltages is integrated, and the integrator output drives a precharge buffer. Thereby, the precharge voltage Vpr is adjusted so that early and late voltages are consistent.

FIG. 8 may be understood as using alternative circuitry within the blocks 312, 356 and 366 of FIG. 3. Exposure and sampling timing circuitry such as shown in FIG. 4, or any equivalent control circuitry, may be employed, and the basic column voltage and current switching may be as previously described. The illustrative buffer 310 may provide precharge voltage at the Vpr output connection 314 for one column (as shown for the buffer 320 in FIG. 3), or for more columns as illustrated for the buffer 310 in FIG. 3. Indeed, a single buffer 310 may provide Vpr for all of the columns driven by a column drive device. The decision may be based on engineering considerations, such as column driver complexity versus flexibility in controlling pixels with varying drive characteristics.

The sample block 356 is described as if the selection switch 822, if used, is closed so that the column connection 358 is connected directly. A switch 818 may be controlled by a "boost+" signal 824 in order to establish an "early" Vcol on a sample capacitor 820 when the boost+signal 824 becomes false. The boost+signal may be generated to have characteristics like the ESamp signal 730 (described above with respect to FIG. 7). A switch 828 may be controlled by a "phi1" signal 830 to establish a "late" Vcol on a sample capacitor 832. The phi1 signal 830 may be generated to have characteristics like the LSamp signal 740 (FIG. 7). A signal "phi2" 834 may be true whenever the switch 828 is open, thereby causing a switch 836 to connect the sample capacitor 832 to a reference input 874 of the combining block 312. Similarly, a signal 835 may be true whenever the sample switch 818 is closed, thereby causing a switch 840 to connect the sample capacitor 820 to a summing input 864 of the combining block 312. The timing of the signals 834 and 835 may also be further restricted. For example, signals 834 and 835 may be the same signal "phi2" if that signal is limited to being active only when both switches 818 and 828 are closed.

The two connections between the sample block 356 and the combining block 312, i.e. the connection of the switch 836 to the reference input 874 and the connection of the switch 840 to the summing input 864, together constitute the connection 357 which is shown between the block 356 and the block 312 in FIGS. 3 and 4. Referring again to FIG. 8, the connection 367 between the sample block 366 and the combining block 312 also includes two connections. The sample block 366 may be constructed just as is the sample block 356, described above, using control signals which are similarly related to the timing of the sampled column(s) as are the control signals described with respect to the sample block 356.

In FIG. 8, the combining circuit 312 is an analog integrator, constructed using an amplifier 810, an integration capacitor 842, and an averaging capacitor 838. The integrator generates an integration output 808 which may be connected directly to a buffer 310, which in turn may provide a Vpr output 314 to selected columns, with or without offsetting as described above with respect to FIG. 6. The value preferred for the capacitors 838 and 842 depend substantially upon the response desired for the integrator, a refresh frame rate for the matrix, and upon the number and size of the sample capacitors (e.g., 820 and 832). They may, but need not, have equal values. The integration capacitor 842, divided by a sum of the sample capacitors (such as 820) that are connected to the summing input 864, is proportional to a time constant of the system. For a typical display having 80 rows and 108 columns and a frame rate of 75 frames per second, with each of the 108 columns having a 0.25 pF sample capacitor like 820, the integration capacitor may need to be about 6.5 nF or more to obtain an acceptably smooth response, and may be located external to the driver device 300. The amount of smoothing may be increased (or the integration capacitor size reduced) in a variety of ways, such as by sampling less than all columns, or sampling less than all rows, or by sampling every element but less than every frame. For example, every column may be sampled using a single combiner block 312 that is connected to 8 sample blocks, each of which is like the sample block 356 except for being selectably connectable to about 14 different columns. If each of these sample blocks samples one matrix element per scan cycle, then every element will be sampled about every 14 frames. As such, the smoothing will be increased, or the integration capacitor may be reduced, by about a factor of 14 compared to a circuit which samples every column at every scan cycle. Of course, it is not even necessary to sample every column; the control voltage may be based upon as few as a single matrix element. Many other techniques may also be used to reduce the size of the integration capacitor, such as providing attenuation between the integration output 808 and the input to the buffer 310 (e.g., a 500 K resistor connecting integration output 808 to buffer 310 input, and 100 K resistor from buffer 310 input to the high voltage supply, or other circuit having a similar effect, may be used).

An analog integrator is illustrated in FIG. 8, but the functions of the circuitry may also be performed digitally by using one or more ADCs and one or more DACs, or their equivalents. Analog to digital conversion may take place at any point that is convenient from an engineering standpoint. For example, the switches 836 and 840 may deliver the sample voltage stored on the respective sample capacitors 832 and 820 to a time-shared ADC to generate digital values representing those samples, such that the reference connection 874 receives a digital value and the summing connection 864 receives a digital value. Integration of these values may be performed by digital processing circuitry, and the buffer 310 may be designed to operate from, or to include, a DAC to convert the result to an output Vpr. As an alternative, and ADC may be configured to convert the analog integration output 808 into a digital value, which may then be stored and manipulated as desired before returning it to the buffer 310 via a DAC. Such alternative digital methods for performing the functions described with respect to FIG. 8 can readily be implemented by the skilled person, and are therefore not further elaborated herein.

Although the sample block 366 is shown having an input connection only to a single column connection 368, it may also have selectable connections to additional columns, as shown and described with respect to the sample block 356. Moreover, any number of additional sample blocks, like 356 and 366, may be connected to a particular combining circuit 312. Alternatively, a single sample block may be connected to a single combining circuit, as shown in FIG. 3 where the sample block 367 and the combiner 322 control the buffer 320; and, as described with respect to that figure, such an arrangement may be repeated for any number of the columns driven by the column driver device 300.

When implementing the teaching of FIG. 8, differences between early and late Vcol (or other representative conduction) voltages determine adjustments to Vpr. Longer exposure periods provide a larger signal for controlling Vpr by permitting more change in Vcol during the exposure, so the circuit gain is partly proportional to the time between early and late samples. As such, a variety of engineering considerations may warrant different techniques than simply taking early samples a fixed short delay after the beginning of each exposure periods, and late samples at about the end of each exposure period. For example, signal to noise ratio may be increased by setting a minimum early-to-late difference, and sampling only elements which have a sufficiently long exposure to permit such sampling. As another example, the gain from all sampled elements may be made more uniform by employing a fixed early-to-late time difference though this will reduce overall sensitivity. Referring momentarily to FIG. 7, the time between the early and late samples is defined by the time between the edge 734 of the ESamp signal 730 and the edge 744 of the LSamp signal 740. If this time is set to a fixed value, while the delay time 736 is constant and the exposure lengths (the time between edges 722 and 724 of the Exp signal 720) vary, then the time between the late sample edge 744 and the edge 724 will vary. A fixed early-late time difference may also be referenced to other points, such as the end of exposure, such that the delay 736 may vary. Thus, the early sample and late sample times may be established with respect to any number of time references. Moreover, when early and late voltages are separately averaged, for example using the circuit of FIG. 8, it is not necessary to obtain both early and late samples from any particular element exposure period. Great flexibility may thus be used to establish early and late samples. "Early" samples are taken at times which, with respect to the period of the exposure to which the early samples correspond, are significantly earlier than the times of "late" samples with respect to the period of the exposure to which the late samples correspond.

Circuits similar to that of FIG. 8 may be configured to control Vpr based on a wide range of alternative combinations of conduction voltages. Various elements and columns may be sampled for differences between early (sometimes called "boost") and late (sometimes called "exposure") voltages. For example, switches such as 850 and 852 may be provided to switchably connect the sample switches 818 and 828 to other columns, generally to only one column at a time. The sampling circuit 356 may thereby be configured to sample any one of the switchably connectable columns during a particular conduction cycle. Furthermore, the combining block 312 may be connected to any number of sampling blocks, such as 356 and 366, each of which may in turn be selectably connected to one or more conduction voltages. For example, the sample block 356 may be connected to just a single column connection 358, as shown in FIG. 3, in which case the column select switch 822 may not be needed. Alternatively, the sample block 356 may selectably sample different columns, such as 358, Column X and Column Y, as shown in FIG. 4. In this case selection switches 822, 850 and 852 are preferably closed at mutually exclusive times if any of the columns are conducting. Typically, the same column will be selected for both an early and a late sample within an exposure period, but it is also possible to sample one column for early samples and another for late samples, or to sample early and late voltages for an element during successive frames. Such techniques may be used, for example, with a digital approach in order to permit use of slow ADCs.

Vpr Control from Vcol Delta Ramps

Figure 9:
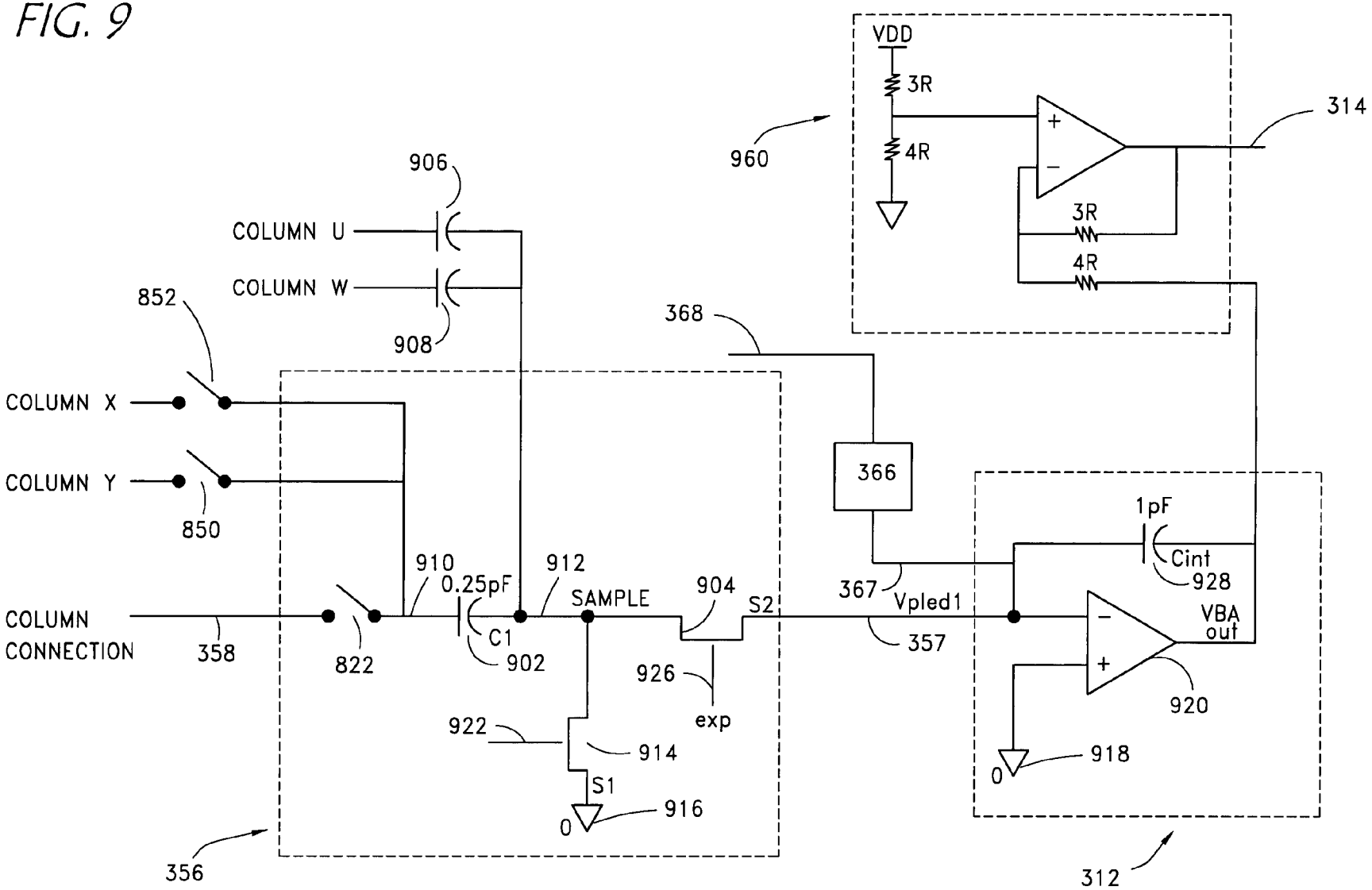
FIG. 9 is a simplified schematic of details for use as shown in FIG. 3 to adapt a precharge voltage in response conduction voltage changes during exposure periods.

FIG. 9 is a simplified schematic representation of a circuit that adjusts Vpr to cause Vcol to remain consistent during exposures by responding to the actual change, or ramp, in Vcol during exposure periods. A convenient method to respond to such voltage change is to capacitively couple one or more column voltages to a combining or sensing circuit which in turn controls Vpr. Other techniques, such as digitally determining an "early" to "late" Vcol differential for an exposure conduction period, and then adjusting Vpr based on a combination of one or more such differentials, may also be used.

FIG. 9 illustrates circuits for adjusting Vpr based upon sensed changes in column conduction voltages Vcol within exposures. An exemplary embodiment of a device for driving a matrix display may be constructed in accordance with the circuits illustrated and described with respect to FIG. 3, except using the details shown in FIG. 9 for the sample blocks 356 and 366 and the integration combiner block 312, connecting them at the appropriate connection points 314, 358, 357 and 367, and replacing the buffer 310 of FIG. 3 with an inverting gain amplifier 960. Thus, the circuits of FIG. 9 may be fabricated to form part of a circuit such as the driver device 300 shown in FIG. 3.

The column connection 358 may be coupled directly to a sense column connection 910, bypassing an optional selection switch 822. The sense column connection 910 may be coupled via a delta sense capacitor 902 to a delta sample connection 912. The delta sample connection point 912 may be connected to a reference voltage 916 via a reset switch 914, when the reset switch control signal 922 is true. When the reset switch 914 is open. a delta sample switch 904 may connect the delta sample connection point 912 of the sample block 356 to the combining circuit 312, shown here to be an inverting delta integration circuit, via an interconnection 357. The delta integration circuit may include an amplifier 920 and an integration capacitor 928, which inversely integrates the current from the delta sense capacitor 902 while the delta sample switch 904 is closed and the reset switch 914 is open. The output of the inverting delta integration circuit 312 may be inverted again through the inverting amplifier 960 to provide Vpr at the connection 314.

In one embodiment, a single amplifier circuit 960 provides Vpr to all columns of a driver device. A single delta integration circuit may be employed in a single combining block 312, with the value of the integration capacitor 928 selected to give the desired response speed. Each column connection (e.g., 358 and 368) may be coupled to it's own sample block (e.g., 356 and 366), and all of the sample blocks may be coupled via a path (e.g., 357, 367) to the integration block. Alternatively, different conduction voltages that reflect the voltage of the column, perhaps indirectly, may be used when convenient. As another alternative, only one or some columns may thus be coupled to the combining block 312. According to yet another alternative, a number of amplifier circuits which each perform a function like 960 may be used, each providing Vpr for one or more columns. If several such amplifier circuits each provide Vpr for different groups of columns, they may be coupled to the output of correspondingly different combining blocks 312, or they may be coupled to a shared combining block 312. In the case that more than one amplifier circuit is driven by a common combining block 312, offset control, such as described above with respect to FIG. 6, may be included in the amplifier in order to permit adjusting Vpr between the groups of columns.

Many alternative methods are available for coupling the Vcol ramps of different columns into a sample circuit such as the sample circuit 356 shown in FIG. 9. First, a sense column connection 910 of the column connection side of the delta sense capacitor 902 may be coupled to the column connection 358 through a selection switch 822, permitting the sense column connection 910 to be connected to a selectable one of a plurality of columns via selection switches, such as the optional selection switches 850 and 852, in a manner similar to that described above with respect to FIG. 8. Second, additional delta sense capacitors, such as optional delta sense capacitors 906 and 908, may each be connected between other columns, such as columns U and W, to the delta sample connection 912. Third, the column connection side of each additional delta sense capacitor (e.g., 906, 908) may in turn be selectably coupled to a number of columns via switches (not shown) employed in a manner similar to the switches 822, 850 and 852.

The delta sample connection 912 may be connected via the sample reset switch 914 to the reference 916, which is the same as a reference 918 for the integration amplifier 920. With the polarities shown, it is convenient to use ground or circuit common as the reference, though a skilled person may design a similar circuit having, for example, reversed polarities or different reference values, without changing the embodiment significantly.

To effect sampling, the sample switch 904 and the sample reset switch 914 should be controlled to reset the voltage of the delta sample connection 912 until the time of the signal of interest (e.g., until the conduction has begun), and then to conduct to the combining circuit those conduction voltage changes (e.g., changes in the voltage of the column connection 358) which occur after reset is released, and before the sample switch 904 is finally opened. The sample reset switch 914 may be closed any time that the sample switch 904 is open, and should be closed for a reset duration until at least slightly (e.g., ¼ $\mu$S to 10 $\mu$S) after the beginning of an exposure period. The reset duration of the sample reset switch 914 is preferably long enough to fully reset the delta sample capacitor 902 (along with optional additional sample capacitors such as 906 and 908, if used) such that the voltage of the delta sample connection point is stable at the reference voltage 916 (ground, in this illustration). A sample reset control signal 922 may, for example, be the ESamp signal 730 (FIG. 7), which is true through the beginning of the exposure conduction period, thereby avoiding transient disturbances.

The delta sample switch 904 may be closed by activation of a controlling Tsample signal 926. The delta sample switch 904 may be closed immediately after the sample reset switch 914 opens, but need only be closed for a transfer duration long enough to transfer, to the combining circuit 312, any ramp charge on delta sense capacitors (e.g., capacitors 902, 906 and 908) which may be coupled to the delta sample switch 904. Charge thus coupled will reflect changes or ramps in conduction voltages between the time of release of the reset connection (i.e., opening of the switch 914) and the time of the release of a subsequent connection through the sample switch 904 (as long as the sample switch 904 is closed and opened before the switch 914 is closed again). The sample switch 904 should be opened to terminate the sample transfer at least before any undesirable transients that may appear at the column connections. In particular, if the column voltage is discharged at the end of exposure, as described elsewhere, the sample switch 904 is preferably opened (Tsample 926 is made false) before such discharge affects the conduction ramp sample. When more than one delta sense capacitor, such as 902, 906 and 908, are connected to the delta sample connection 912, the sample switch 904 should be opened before discharge of any of the columns coupled to those delta sense capacitors which were charged to a conduction voltage. The Tsample signal 926 may be active during most of the exposure conduction period (or until the end of the shortest exposure period, in the case of multiple delta sense capacitors). At the beginning of the exposure conduction period, Tsample should remain inactive until the sample reset switch 914 is fully open, while toward the end of the exposure conduction period Tsample may be released at, or a short time (e.g., ¼ to 4 $\mu$S) before, the end of the exposure period. The signal LSamp 740, described with respect to FIG. 7, satisfies the timing requirements for the delta sample switch 904 for a single sense capacitor, and thus may be used for Tsample 926 in that case. The period between release of the sample reset control signal 922 and the release of Tsample is the effective ramp sample period, and the edges controlling this period may in general have all of the flexibility which "early" and "late" samples may have within an exposure period, as described above with respect to the circuit of FIG. 8.

If two or more delta sample capacitors are connected at the sample point 912, then the Tsample signal 926 is preferably active only while all of the columns coupled to the sample point 912 via a delta sense capacitor are conducting, and thus should be made inactive before any transient voltages which may occur at the end of the shortest of the exposures of the sampled columns. In this circumstance, the logical "and" of all LSamp 740 (FIG. 7) signals, corresponding to the plurality of delta sample capacitors that are coupled to the delta sample point 912, may be used for Tsample 926. The sample reset signal 922 may remain, for example, the same as ESamp 730 (FIG. 7).

In the foregoing manner, output from the sample block 356 may be based upon signals from any selectable combination of exposed (i.e., conducting) columns during a particular scan cycle. Each delta sense capacitor (e.g., 902, 906, 908) that is coupled to the sample point 912, and in turn is connected to a selected column, provides one of the selected combinations of column signals. The output of the sample block 356 may be coupled to the combining circuit 312 via the connection 357, and additional sample blocks, such as the sample block 366, may also be connected to the combining circuit 312.

The combination of the combiner circuit 312 and the amplifier circuit 960 should be non-inverting with respect to the input signal(s) from the (one or more) column connection(s). With the polarities shown for the delta integration circuit illustrated in the combiner block 312, an inverting amplifier circuit 960 may be employed instead of an ordinary buffer 310 to provide Vpr at the connection 314. Gain may be set at these stages, and the integrator places a pole at zero samples per second to yield high gain at steady state. It may be convenient to set Vpr from the inverting amplifier 960 to be a minimum of Vdd/4 and a maximum of Vdd, for an amplifier (e.g., 920) having an output voltage range of 0 to Vdd, by using resistor ratios as shown in FIG. 9. Any circuit which is compatible with the driver device may be used to replace the integration circuit, along with the inverting amplifier 960, so long as it causes the net buffered value Vpr 314 to cover a wide enough range, and to shift across time in the same direction as does the voltage of Vcol during exposure, and as long as it creates a stable loop. Typically, overdamped stability is acceptable. The integration capacitor 928 may be about 3 to 10 times a sum of all delta sense capacitors (such as 902, 906, 908, etc. for the sample block 356, and those similarly coupled to all other sample blocks connected to the combining block 312) during a frame (i.e., a sequential scan of all rows). Each delta sense capacitor may, for example, be about 0.25 pF.

Alternatives and Extensions

While the above description has pointed out novel features of the invention as applied to various embodiments, the skilled person will understand that various omissions, substitutions, and changes in the form and details of the device or process illustrated may be made without departing from the scope of the invention. For example, those skilled in the art will understand that the orientation, polarity, and connections of devices in the display matrix are matters of design convenience. Other details may be varied, as well. For example, the current supplied during conduction periods is typically constant, but need not be. So long as the total charge delivered to elements during conduction periods is known and controlled, a precharge voltage which causes the conduction voltage (e.g., Vcol) change during the exposure periods to be null will assure that the delivered charge is equal to the charge conducted by the target element. As another example, zero is typically the desired change in the conduction voltage during the exposure, but other voltages are possible. In one possibility, the precharge voltage may be intentionally higher than equilibrium. Such a Vpr may be established easily using digital sampling and programmatic control, or in the circuits of FIGS. 8 and 9 the integrator or amplifier (or buffer) providing Vpr may have a selected positive offset voltage. Indeed, it may be controllable as with FIG. 6. The skilled person can implement such alternatives if engineering considerations warrant their use. The skilled person will also be able to adapt the details described herein to a system having different devices, different polarities, or different row and column architectures. All such alternative systems are implicitly described by extension from the description above, and are contemplated as alternative embodiments of the invention. Therefore, the scope of the invention is defined by the appended claims rather than by the foregoing detailed description. All variations coming within the meaning and range of equivalency of the claims are embraced within their scope.

What is claimed is:

1. A method of controlling a precharge voltage for a matrix display, the method comprising:

driving a first current during a first conduction period through a first matrix element;

determining an early voltage of a path of the first current at a first point in time which is nearer to a beginning than to an end of the first conduction period;

driving a second current during a second conduction period through a second matrix element;

determining a late voltage of a path of the second current at a second point in time which is after the first point in time; and adjusting a precharge voltage in response to a difference between a combination of the early voltage and the late conduction voltage.

2. The method of claim 1, wherein the first and second matrix elements comprise organic light emitting diodes (OLEDs).

3. The method of claim 1, wherein the first and second conduction periods are the same.

4. The method of claim 1, wherein the combination of one or more early voltages includes a plurality of nonconcurrent early voltages.

5. The method of claim 1, wherein the combination of one or more late voltages includes a plurality of nonconcurrent late voltages.

6. The method of claim 1, wherein the combination of one or more early voltages includes concurrent early voltages.

7. The method of claim 1, wherein the combination of one or more late voltages includes concurrent late voltages.

8. The method of claim 1, wherein the combination of one or more early voltages includes nonconcurrent early voltages.

9. The method of claim 1, wherein:

the combination of one or more early voltages includes concurrent early voltages;

the combination of one or more late voltages includes concurrent late voltages; and the step of adjusting the precharge voltage further includes integrating differences between a temporal average of the combination of early voltages and a temporal average of the combination of late voltages.

10. A method of manufacturing an apparatus for adaptively controlling a level of precharge voltage applied to matrix connections, the method comprising:

connecting a first current source and a first matrix element as a first current drive circuit;

configuring the first current drive circuit to couple current from the first current source to the first matrix element during a first conduction period;

coupling an early voltage sampling circuit to the first matrix element;

configuring the early voltage sampling circuit to sample an early voltage related to a voltage of the first matrix element during an early portion of the first conduction period;

connecting a second current source and a second matrix element as a second current drive circuit;

configuring the second current drive circuit to couple current from the second current source to the second matrix element during a second conduction period;

coupling a late voltage sampling circuit to the second matrix element;

configuring the late voltage sampling circuit to sample a late voltage related to a voltage of the second matrix connection during a late portion of the second conduction period;

coupling a precharge circuit to a third matrix element;

coupling the early and late voltage sampling circuits to comparators configurable to provide control information based on comparison of the early and late voltages; and configuring the precharge circuit to output a precharge voltage which reflects the control information from the comparators.

11. The method of claim 10, wherein:

the first and second matrix elements are the same; and the first and second current source are the same.

12. The method of claim 10, wherein the first and second conduction periods are the same.

13. The method of claim 10, wherein:

the early voltage sampling circuit is a shared voltage sampling circuit configured to sample voltages at an early time, with respect to the corresponding conduction period; and the late voltage sampling circuit is substantially the shared voltage sampling circuit configured to sample voltages at a later time, with respect to the corresponding conduction period, than early voltage sample times.

14. The method of claim 10, further comprising:

coupling the voltage sampling circuits to a data communication device configured to communicate data representing early and late voltage values to a processing device; and coupling the data communication device to DAC circuitry configured to communicate digital information from the processing device to the precharge circuit.

15. The method of claim 10, further comprising switchably coupling the early voltage sampling circuit to a plurality of matrix connections.

16. The method of claim 10, further comprising coupling the precharge voltage to a plurality of matrix elements.

17. The method of claim 10, further comprising incorporating early sample voltage averaging circuitry and late sample voltage averaging circuitry into the comparator.

18. The method of claim 17, further comprising determining whether averaged early voltages are greater than averaged late voltages.

19. The method of claim 18, further comprising:

configuring a precharge register to control value of the precharge voltage.

20. The method of claim 17, further comprising configuring the comparator to average concurrent early voltages, and to average concurrent late voltages.

21. The method of claim 17, further comprising configuring the comparator to average nonconcurrent early voltages, and to average nonconcurrent late voltages.

22. The method of claim 10, further comprising incorporating into the comparator an integrator configured to integrate differences between the early voltages and the late voltages as a basis for the control information.

23. The method of claim 10, further comprising coupling the early voltage sampling circuit to a plurality of matrix elements, and coupling the late voltage sampling circuit to a plurality of matrix elements.

24. The method of claim 10, further comprising providing a combiner configured to combine a plurality of nonconcurrent early voltages.

25. The method of claim 10, further comprising providing a combiner configured to combine a plurality of concurrent early voltages.

26. A method of controlling a precharge voltage to be provided to a matrix display element, the method comprising:

applying a first current to a first matrix element during a first conduction period;

obtaining early voltages in a path of the first current;

applying a second current to a second matrix element during a second conduction period;

obtaining late voltages in a path of the second current; and providing a precharge voltage based at least in part on comparison of the early voltages and the late voltages.

27. The method of claim 26, wherein the first and second matrix elements are the same.

28. The method of claim 26, wherein the first and second conduction periods are the same.

29. The method of claim 26, further comprising providing different precharge voltages to different column drivers, respectively, within a column driver device.

30. The method of claim 29, further comprising providing a plurality of distinct precharge voltages based upon early and late voltages derived from different matrix elements.

31. An apparatus for controlling a precharge voltage provided to at least one display element during a first precharge period, comprising:

means for providing a first current to a first display element during a first conduction period;

means for obtaining an early voltage derived from the first display element at an early time of the first conduction period;

means for providing a second current to a second display element during a second conduction period;

means for obtaining a late voltage derived from the second display element at a late time of the second conduction period;

means for adjusting a precharge voltage in response to a difference between one or more early voltages and one or more late voltages.

32. The apparatus of claim 31, wherein the first and second display elements are the same.

33. The apparatus of claim 31, wherein the first and second conduction periods are the same.

34. The apparatus of claim 31, wherein the one or more early voltage is a combination of early voltages from a plurality of early conduction periods.

35. The apparatus of claim 34, wherein the one or more late voltages is a combination of late voltages from a plurality of late conduction periods.

36. The apparatus of claim 31, wherein the one or more early voltages is a combination of early voltages from a plurality of display elements.

37. The apparatus of claim 36, wherein the one or more late voltages is a combination of early voltages from a plurality of display elements.

38. The apparatus of claim 31, wherein the late voltage is a combination of late voltages from a plurality of conduction periods.

39. The apparatus of claim 31, wherein:

the early time is within 10 microseconds of a beginning the first conduction period; and the late time is at a time later than a time midpoint of the second conduction period.

40. The apparatus of claim 31, wherein:

the early time is within 10 microseconds of a beginning of the first conduction period; and the late time is substantially a constant time after a beginning of the second conduction period.

41. The apparatus of claim 31, wherein:

the early time is within 10 microseconds of the first conduction period; and the late time is within 10 microseconds of an end of the second conduction period.

42. An apparatus for driving at least one to matrix element to a precharge voltage level, the apparatus comprising:

a first current source coupled to a first conduction line of a first matrix element during a first conduction period;

an early voltage sampling circuit configured to sample a voltage relating to the first conduction line during an early portion of the first conduction period as an early voltage sample;

a second current source coupled to a second conduction line of a second matrix element during a second conduction period;

a late voltage sampling circuit configured to sample a voltage relating to the second conduction line during a late portion of the second conduction period as a late voltage sample;

a comparison circuit configured to compare at least one early voltage sample with at least one late voltage sample; and a precharge source configured to adjust a precharge voltage output based at least in part on outcome of the comparison of the early and late voltage samples.

43. The apparatus of claim 42, wherein the first and second conduction lines are the same.

44. The apparatus of claim 42, wherein the first and second conduction periods are the same.

45. The apparatus of claim 42, wherein the at least one early voltage sample includes a plurality of samples of nonconcurrent early voltages.

46. The apparatus of claim 42, wherein the at least one late conduction voltage includes a plurality of samples of nonconcurrent late voltages.

47. The apparatus of claim 42, wherein the at least one early voltage sample includes a plurality of samples of concurrent early voltages.

48. The apparatus of claim 42, wherein the at least one early voltage sample includes a plurality of samples of concurrent late voltages.

49. The apparatus of claim 42, wherein the voltage relating to the first conduction line is the voltage of the first conduction line.

50. The apparatus of claim 42, wherein the precharge voltage output is connectable to a plurality of conduction lines.

51. The apparatus of claim 42, further comprising a plurality of precharge voltage outputs connectable to a plurality of conduction lines, respectively.

52. The apparatus of claim 51, further comprising an offset circuit configured to offset one of the plurality of precharge voltages from another.

53. The apparatus of claim 42, wherein the comparison circuit further comprises an integrator configured to integrate differences between the early and late voltage samples.

54. The apparatus of claim 53, wherein the integrator is further configured to integrate differences between a combination of time-averaged early voltage samples and a combination of time-averaged late voltage samples.

55. The apparatus of claim 54, wherein the early voltage samples comprise a combination of concurrent early voltages, and the late voltage samples comprise a combination of concurrent late voltages.

56. The apparatus of claim 42, wherein the early portion of the first conduction period is between a beginning and a midpoint time of the first conduction period.

57. The apparatus of claim 42, wherein the early portion of the first conduction period is within four microseconds of a beginning of the first conduction period.

58. The apparatus of claim 42, wherein the late portion of the second conduction period is between a midpoint time and an end of the second conduction period.

59. The apparatus of claim 42, wherein the late portion of the second conduction period is within four microseconds of an end of the second conduction period.

60. An apparatus for displaying information, comprising:

a matrix of luminescent elements each coupled to a column and a row;

a row driver circuit configured to enable current flow through elements connected to a selected row during a row scan cycle;

a column driver circuit configured to:

provide current to column connections of elements during corresponding conduction periods;

sample an early voltage from a first column connection voltage;

sample a late voltage from a second column connection voltage; and generate a precharge voltage based upon a difference between one or more early voltage values and one or more late voltage values.

61. The apparatus of claim 60, wherein the column driver circuit comprises an integrator to integrate differences between early voltage values and late voltage values.

62. The apparatus of claim 60, wherein the display comprises a matrix of light emitting diode (LED) devices.

63. The apparatus of claim 62, wherein the LEDs are OLEDs or PLEDs.

64. The apparatus of claim 60, wherein the column driver comprises an analog to digital converter device to digitize early voltage samples.

65. The apparatus of claim 60, wherein the column driver comprises a digital to analog converter device to control the precharge voltage.

66. The apparatus of claim 60, wherein the first column connection voltage relates to a same circuit point as the second column connection voltage.

* * * * *